US012571158B2

(12) United States Patent
Iwamoto et al.

(10) Patent No.: US 12,571,158 B2
(45) Date of Patent: Mar. 10, 2026

(54) NAPPED ARTIFICIAL LEATHER

(71) Applicant: KURARAY CO., LTD., Kurashiki (JP)

(72) Inventors: Akihisa Iwamoto, Okayama (JP); Masashi Meguro, Okayama (JP); Hiroyuki Hishida, Okayama (JP); Kiyofumi Enomoto, Kurashiki (JP)

(73) Assignee: KURARAY CO., LTD., Kurashiki (JP)

( * ) Notice: Subject to any disclaimer, the term of this patent is extended or adjusted under 35 U.S.C. 154(b) by 416 days.

(21) Appl. No.: 17/753,576

(22) PCT Filed: Sep. 3, 2020

(86) PCT No.: PCT/JP2020/033431
§ 371 (c)(1),
(2) Date: Mar. 8, 2022

(87) PCT Pub. No.: WO2021/049413
PCT Pub. Date: Mar. 18, 2021

(65) Prior Publication Data

US 2022/0333299 A1 Oct. 20, 2022

(30) Foreign Application Priority Data

Sep. 10, 2019 (JP) ..... 2019-164364
Aug. 17, 2020 (JP) ..... 2020-137614

(51) Int. Cl.
*D06N 3/00* (2006.01)
*D06N 3/14* (2006.01)

(52) U.S. Cl.
CPC ..... *D06N 3/0004* (2013.01); *D06N 3/0011* (2013.01); *D06N 3/14* (2013.01); *D06N 2211/28* (2013.01)

(58) Field of Classification Search
CPC ..... D06N 3/0004; D06N 3/0011; D06N 3/14; D06N 3/0036; D06N 3/0075;
(Continued)

(56) References Cited

U.S. PATENT DOCUMENTS 6,114,260 A * 9/2000 Kim ..... D06N 3/0077 427/373
2006/0008631 A1 1/2006 Takeyama et al.
(Continued)

FOREIGN PATENT DOCUMENTS

JP 51-75178 6/1976
JP 6-316877 11/1994
(Continued)

OTHER PUBLICATIONS

International Search Report issued Nov. 2, 2020, in PCT/JP2020/033431, with English translation, 5 pages.
(Continued)

*Primary Examiner* — Larissa Rowe Emrich
(74) *Attorney, Agent, or Firm* — Grüneberg Global IP, PLLC

(57) ABSTRACT

A napped artificial leather includes: a non-woven fabric that is art entangled body of ultrafine fibers, and an elastic polymer applied into the non-woven fabric; where the napped artificial leather has, on at least one side thereof, a napped surface formed by napping the ultrafine fibers. Each of the ultrafine fibers is art ultrafine fiber having a fineness of 0.5 dtex or less, and a tensile strength of 6 to 9 mN. A plurality of the ultrafine fibers form a fiber bundle, and the ultrafine fibers that form the fiber bundle are not constrained by the elastic polymer in a region of the napped artificial leather other than a surface layer portion. A content ratio of the elastic polymer is 16 to 40 mass %, and the napped artificial leather has an apparent density of 0.38 g/cm$^3$ or more.

7 Claims, 3 Drawing Sheets

(58) Field of Classification Search
CPC ..... D06N 2203/068; D06N 2205/24; D06N 2205/246; D06N 2211/28; D06N 2213/03; D06N 3/0043–0054; D04H 3/105; D04H 3/016
See application file for complete search history.

(56) References Cited

U.S. PATENT DOCUMENTS

| | | | | |
|---|---|---|---|---|
| 2010/0129592 | A1 | 5/2010 | Nishimura et al. | |
| 2017/0211227 | A1 | 7/2017 | Fujisawa et al. | |
| 2018/0230645 | A1 | 8/2018 | Hirose et al. | |
| 2020/0263351 | A1* | 8/2020 | Meguro ..... | D06N 3/145 |

FOREIGN PATENT DOCUMENTS

| | | | |
|---|---|---|---|
| JP | 2001-81677 | | 3/2001 |
| JP | 2004-197232 | | 7/2004 |
| JP | 2007-100249 | | 4/2007 |
| JP | 2008-196080 | | 8/2008 |
| JP | 2008196080 | A * | 8/2008 |
| JP | 2011-74541 | | 4/2011 |
| JP | 2013-194325 | | 9/2013 |
| JP | 2014-25165 | | 2/2014 |
| JP | 2017-106127 | | 6/2017 |
| JP | 2019-26996 | | 2/2019 |
| JP | 2019-127662 | | 8/2019 |
| TW | 201623720 | | 7/2016 |
| TW | 201712187 | | 4/2017 |
| WO | 2019/058924 | | 3/2019 |

OTHER PUBLICATIONS

Written Opinion issued Nov. 2, 2020, in PCT/JP2020/033431, with English translation, 7 pages.
Extended European Search Report dated Jul. 20, 2023, in European Application No. 20862802.4, 6 pages.

* cited by examiner

NAPPED ARTIFICIAL LEATHER

CROSS-REFERENCE TO RELATED APPLICATIONS

This application is the National Stage entry under § 371 of International Application No. PCT/JP2020/033431, filed on Sep. 3, 2020, and which claims the benefit of priority to Japanese Application No. 2019-164364, filed on Sep. 10, 2019; and priority to Japanese Application No. 2020-137614, filed on Aug. 17, 2020. The content of each of these applications is hereby incorporated by reference in its entirety.

TECHNICAL FIELD

The present invention relates to a napped artificial leather that can be preferably used as clothing, shoes, articles of furniture, car seats, a surface material for general merchandise, and the like.

BACKGROUND ART

Conventionally, napped artificial leathers such as a suede-like artificial leather and a nubuck-like artificial leather are known. Napped artificial leathers have a napped surface that includes napped fibers and is formed by napping one surface of a non-woven fabric into which an elastic polymer has been impregnated. Such napped artificial leathers are required to have abrasion resistance.

As for the abrasion resistance of napped artificial leathers, for example, PTL 1 listed below discloses: a suede-like artificial leather obtained by extracting, in a leather-like sheet material including ultrafine fibers and an elastic polymer, one component of a fiber mixture after applying the elastic polymer into leather-like sheet material, and thereafter applying the elastic polymer again, whereby the ultrafine fibers forming the fiber bundle are constrained by the elastic polymer.

PTL 2 listed below discloses a flexible artificial leather having good abrasion resistance: The artificial leather is obtained by adding, into a non-woven sheet-like material including, as a surface fiber layer, a fiber layer made of ultrafine fibers with a single fiber fineness of 0.5 deniers or less, a treating liquid obtained by dissolving and mixing inorganic salts into an aqueous polyurethane emulsion with an average emulsion particle size of 0.1 to 2.0 μm, and thereafter drying the sheet-like material under heating.

PTL 3 listed below discloses an artificial leather obtained by forming an artificial leather substrate, and thereafter swelling an elastic polymer with a solvent, followed by compression, thus bonding ultrafine fibers and the elastic polymer together.

PTL 4 listed below discloses a napped artificial leather including: a non-woven fabric obtained by entangling fibers; and an elastic polymer, in which a 100% modulus (A) of the elastic polymer and a content ratio (B) of the elastic polymer satisfy the relational expression: $B \geq -1.8A+40$, $A>0$.

PTL 5 listed below discloses a sheet-like material for which an artificial leather including: a non-woven fabric composed mainly of ultrafine fibers; and an elastic polymer is used, in which the non-woven fabric is formed by a non-woven fabric including ultrafine filaments that contain polyester as a main component, 1 to 500 ppm of a component derived from 1,2-propane diol is contained in the polyester, and the CV value of a basis weight in the width direction is 5% or less.

Also, napped artificial leathers have the problem of pilling, which is a phenomenon in which ultrafine fibers fall out or are cut as a result of the napped surface being rubbed, and the ultrafine fibers released on the surface are further rubbed and are thereby entangled with each other, to form small spherical pill-like masses.

As a method for suppressing the pilling of a napped artificial leather, for example, a method in which the ultrafine fibers are constrained by increasing the degree of entanglement of the ultrafine fibers forming the non-woven fabric, or by increasing the content ratio of the elastic polymer impregnated into the non-woven fabric or foaming the elastic polymer, or a method in which the ultrafine fibers are made likely to be cut by reducing the strength thereof. However, there are problems in that the texture becomes hard when the degree of constraint of the ultrafine fibers is increased by increasing the content ratio of the elastic polymer impregnated into the forming the non-woven fabric, and the manufacturing cost is increased when the constraining force is increased by foaming the elastic polymer to increase the substantial volume. There is also a problem in that when the ultrafine fibers are made likely to be cut by reducing the strength thereof, the abrasion resistance is reduced although pilling is less likely to occur.

As for a napped artificial leather having excellent pilling resistance, PTL 6 listed below discloses a napped artificial leather in which the degree of entanglement of ultrafine fibers is increased, and a napped surface has a rate of change in an L* value based on the L*a*b*color system of, +9% or less as measured by a spectrophotometer before and after a surface release treatment for releasing the napped surface.

As a technique for improving the abrasion resistance or a napped artificial leather, for example, PTL 7 listed below discloses a napped artificial leather in which an elastic polymer obtained from an aqueous dispersion of the elastic polymer is present at the base of napped fibers and in the vicinity thereof.

CITATION LIST

Patent Literatures

[PTL 1] Japanese Laid-Open Patent Publication No. S51-75178

[PTL 2] Japanese Laid-Open Patent Publication No. 106-316877

[PTL 3] Japanese Laid-O-pen Patent Publication No. 2001-81677

[PTL 4] WO 2019/058924

[PTL 5] Japanese Laid-Open Patent Publication No. 2019-26996

[PTL 6] Japanese Laid-Open Patent Publication No. 2017-106127

[PTL 7] Japanese Laid-Open Patent Publication No. 2011-74541

SUMMARY OF INVENTION

Technical Problem

The suede-like artificial leather disclosed in PTL 1 as problematic in that, although the abrasion resistance has been improved, the texture of the artificial leather is hard because the elastic polymer constrains the ultrafine fibers. The artificial leather disclosed in PTL 2 is also problematic in that, although the abrasion resistance has been improved, the texture of the artificial leather is hard. Furthermore, the artificial leather disclosed in PTL 3 is also problematic an that, because the elastic polymer constrains the ultrafine fibers, the texture of the artificial leather becomes hard if the abrasion resistance is to be sufficiently improved. The artificial leather disclosed in PTL 4 is also problematic in that, although the abrasion resistance has been improved, the colour fastness to rubbing, which is affected by falling out of the ultrafine fibers, has not been sufficiently improved. The artificial leather disclosed in PTL 5 is also problematic in that, although the abrasion resistance has been improved, the texture of the artificial leather is hard because the elastic polymer constrains the ultrafine fibers, because the elastic polymer is applied after forming ultrafine fibers from island-in-the-sea composite fibers.

The napped artificial leather disclosed in PTL 6, in which the degree of entanglement of ultrafine fibers has been increased, is problematic in that, although the pilling resistance has been improved, the texture becomes hard. The napped artificial leather disclosed in PTL 7 is also problematic in that, although the napped artificial leather exhibits excellent abrasion resistance, its texture becomes hard because the elastic polymer constrains the ultrafine fibers.

It is an object of the present invention to provide a napped artificial leather having a combination of an elegant napped appearance, high abrasion resistance, high colour fastness to rubbing, and a soft texture.

Solution to Problem

An aspect of the present invention is directed to a napped artificial leather including: a non-woven fabric that is an entangle body of ultrafine fibers; and an elastic polymer applied into the non-woven fabric, the napped artificial leather having, on at least one side thereof, a napped surface formed by napping the ultrafine fibers, wherein each of the ultrafine fibers is an ultrafine fiber having a fineness of 0.5 dtex or less and a tensile strength of 6 to 9 mN, and a plurality of the ultrafine fibers form a fiber bundle, the ultrafine fibers that form the fiber bundle are not constrained by the elastic polymer in a region of the napped artificial leather other than a surface layer portion, a content ratio of the elastic polymer is 16 to 40 mass %, and the napped artificial leather has an apparent density of 0.38 g/cm$^3$ or more. Such a napped artificial leather can provide a napped artificial leather having a combination of an elegant napped appearance, high abrasion resistance, high colour fastness to rubbing, and a soft texture. Note that ultrafine fibers being not constrained by the elastic polymer means a state in which ultrafine fibers forming a non-woven fabric form a fiber bundle formed by removing a sea component from island-in-the-sea composite fibers, and the fibers are not fixed to each other by the elastic polymer in the ultrafine fiber bundle formed by removing the sea component from the island-in-the-sea composite fibers. When the fibers are not fixed to each other by the elastic polymer in the ultrafine fiber bundle, the ultrafine fibers are assumed to be not constrained by the elastic polymer even if the elastic polymer is fixed to a portion of the periphery of the ultrafine fiber bundle.

It is preferable that the tensile strength of the ultrafine fibers is a tensile strength A (mN) in the range of 6.5 to 8 mN, the apparent density of the napped artificial leather is 0.38 to 0.48 q/cm$^3$, and a content ratio B (%) of the elastic polymer satisfies $3.125 \times A \leq B$. Such a napped artificial leather can provide a napped artificial leather having high pilling resistance as well.

It is preferable that the elastic polymer is a solvent-based polyurethane, because a napped artificial leather having a soft texture is likely to be obtained by suitably dissociating the elastic polymer and the ultrafine fibers even when the amount of the polyurethane is increased.

It is preferable that the elastic polymer has an expansion ratio of 0 to 5 mass %. When the elastic polymer is foamed at a high ratio, the elastic polymer is increased in volume and surrounds the ultrafine fibers, so that the ultrafine fibers become less likely to fall out, resulting in an increase in the pilling resistance. However, this is not preferable because, in order to form the elastic polymer at a high ratio, it is necessary to adjust additives, or increase the coagulation temperature, so that the manufacturing cost tends to be increased.

It is preferable that a portion of the elastic polymer that is present in the surface layer portion is fixed to the vicinity of a base of the napped ultrafine fibers, because the napped fibers on the napped surface become less likely to fall out, and the appearance quality is improved as a result of the napped fibers becoming less likely to be raised by friction.

It is preferable that each of the ultrafine fibers is an ultrafine fiber formed by removing by dissolution a sea component from an island-in-the-sea composite fiber, using an organic solvent, because the napped artificial leather as described above is likely to be obtained.

It is preferable that the non-woven fabric is a spunbonded non-woven fabric including the ultrafine fibers of filaments, because the napped artificial leather as described above is likely to be obtained.

Advantageous Effects of Invention

According to the present invention, it is possible to obtain a napped artificial leather having a combination of an elegant napped appearance, high abrasion resistance, high colour fastness to rubbing, and a soft texture.

DESCRIPTION OF EMBODIMENT

Figure 1A:
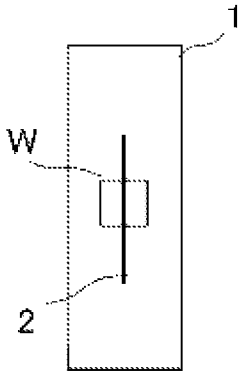
FIG. 1A shows part of an illustrated method for measuring the tensile strength of ultrafine fibers, where a mold frame is obtained.

A napped artificial leather according to the present embodiment is a napped artificial leather including: a non-woven fabric that is an entangle body of ultrafine fibers; and an elastic polymer applied into the non-woven fabric, the napped artificial leather having, on at least one side thereof, a napped surface formed by napping the ultrafine fibers, wherein each of the ultrafine fibers is an ultrafine fiber having a fineness of 0.5 dtex or less and a tensile strength of 6 to 9 mN, and a plurality of the ultrafine fibers form a fiber bundle, the ultrafine fibers that form the fiber bundle are not constrained by the elastic polymer in a region of the napped artificial leather other than a surface layer portion, a content ratio of the elastic polymer is 16 to 40 mass %, and the napped artificial leather has an apparent density of 0.38 g/cm$^3$ or more. Hereinafter, a napped artificial leather according to the present embodiment will be described in detail, in con unction with a description of an example of the production method thereof.

The non-woven fabric that is an entangle body of ultrafine fibers is a non-woven fabric of fiber bundles of ultrafine fibers in which a plurality of ultrafine fibers form each of the fiber bundles. Such a non-woven fabric can be obtained by subjecting island-in-the-sea (matrix-domain) composite fibers to entangling, and then to ultrafine fiber-generating treatment.

Examples of the production method of a non-woven fabric that is an entangle body of ultrafine fibers include a method in which island-in-the-sea composite fibers are melt spun to produce a web, and the web is subjected to entangling, and thereafter the sea component is selectively removed from the island-in-the-sea composite fibers, to form ultrafine fibers. In any of the processes until the sea component of the island-in-the-sea composite fibers is removed to forms ultrafine fibers, fiber shrinking such as heat shrinking using water vapor or hot water, or using dry-heating may be performed to densify the island-in-the-sea composite fibers.

Examples of the production method of the web include a method in which island-in-the-sea composite fibers that have been spun by spunbonding are collected on a net, without being cut, to form a filament web. As an alternative method, a raw stock of staples of the island-in-the-sea composite fibers obtained by crimping and cutting the melt spun island-in-the-sea composite fibers may be carded, to form a staple web. Among these, it is particularly preferable to use a filament web derived from the island-in-the-sea composite fibers that have been spun by spunbonding, because the entangled state can be easily adjusted, and a high level of fullness can be achieved. In addition, the formed web may be fusion bonded in order to impart shape stability thereto. In the following, an example in which filaments of island-in-the-sea composite fibers are used will be described in detail as a representative example.

Note that a filament means a continuous fiber, rather than a staple that has been intentionally cut after being spun. More specifically, the filament means a filament or a continuous fiber other than a staple that has been intentionally cut so as to have a fiber length of about 3 to 80 mm, for example. In order to form a filament, the fiber length of the island-in-the-sea composite fibers before being subjected to the ultrafine fiber generation is preferably 100 mm or more, and may be several meters, several hundred meters, several kilometers, or more, as long as the fibers are technically producible and are not inevitably cut during the production processes. Note that some of filaments may be inevitably cut into staples in the production process due to needle punching during entanglement, or surface buffing.

Examples of the type of the resin for the island component that is to form ultrafine fibers include fibers of aromatic polyesters such as polyethylene terephthalate (PET), modified PETs such as isophthalic acid-modified PET, sulfoisophthalic acid-modified PET and cationic dye-dyeable modified PET, polybutylene terephthalate, and polyhexamethylene terephtalate; aliphatic polyesters such as polylactic acid, polyethylene succinate, polybutylene succinate, polybutylene succinate adipate, and a polyhydroxybutyrate-polyhydroxyvalerate resin; nylons such as nylon 6, nylon 66, nylon 10, nylon 11, nylon 12, and nylon 6-12; and polyolefins such as polypropylene, polyethylene, polybutene, polymethylpentene, and a chlorine-based polyolefin. Note that a modified PET is a PET obtained by substituting at least a portion of an ester-forming dicarboxylic acid-based monomer unit or a diol-based monomer unit of an unmodified PET with a monomer unit capable of substituting these units. Specific examples of the modified monomer unit capable of substituting the dicarboxylic acid-based monomer unit include units derived from an isophthalic acid, a sodium sulfoisophthalic acid, a sodium sulfonaphthalene dicarboxylic acid, and an adipic acid that are capable of substituting a terephthalic acid unit. Specific examples of the modified monomer unit capable of substituting a diol-based monomer unit include units derived from diols, such as a butane diol and a hexane diol, that are capable of substituting an ethylene glycol unit.

If necessary, for example, dark-color pigments such as carbon black, white pigments such as zinc white, white lead, lithopone, titanium dioxide, precipitated barium sulfate and barytes powder, a weathering agent, an antifungal agent, a hydrolysis inhibitor, a lubricant, fine particles, a frictional resistance adjustor, and the like may be blended in the island-in-the-sea composite fibers, as long as the effects of the present invention are not impaired.

In order to form a non-woven fabric including fiber bundles of ultrafine fibers having a fineness of 0.5 dtex or less and a tensile strength of 6 to 9 mN, the following method may be used, for example. A thermoplastic resin having a relatively high intrinsic viscosity or melting point is selected as the island component of island-in-the-sea composite fibers for producing ultrafine fibers, a thermoplastic resin that is solidified more slowly than the island component is selected as the sea component, and melt spinning is performed while spinning the island component at a spinning draft (discharge rate/spinning rate) of a certain level or higher.

The intrinsic viscosity of the resin for the island component for obtaining ultrafine fibers is preferably about 0.55 to 0.8 dl/g, and more preferably about 0.55 to 0.75 dl/g, because ultrafine fibers having a fineness of 0.5 dtex or less and a tensile strength of 6 to 9 mN can be easily formed. When the intrinsic viscosity of the thermoplastic resin that is to form the island component is too low, the tensile strength of the resulting ultrafine fibers tends to be low. When the intrinsic viscosity of the thermoplastic resin that is to form the island component is too high, it becomes difficult to perform melt spinning, so that it becomes difficult to obtain ultrafine fibers having a fineness of 0.5 dtex or less and a tensile strength of 6 to 9 mN.

As the resin for the sea component that is to be removed by extraction or by decomposition at a subsequent time, a resin that differs from the resin for the island component in solubility or decomposability, and that has low compatibility therewith can be used. Such a resin may be selected as appropriate according to the type and the production method of the resin for the island component. Specific examples thereof include olefin-based resins such as polyethylene, polypropylene, an ethylene-propylene copolymer, and an ethylene vinyl acetate copolymer, such as polystyrene, a styrene-acrylic copolymer, and a styrene ethylene copolymer, that have solubility in an organic solvent and that can be removed by dissolution in an organic solvent; and water-soluble resins such as water-soluble polyvinyl alcohol. Among these, from the viewpoint that the resin for the island component that has a high intrinsic viscosity can be melt spun, the resin that can be removed by dissolution in an organic solvent is preferable, and polyethylene is particularly preferable.

A web of the island-in-the-sea composite fibers can be produced by spunbonding, in which, using a multicomponent fiber spinning spinneret having multiple nozzle holes arranged in a predetermined pattern, a melt strand of the island-in-the-sea composite fibers is continuously discharged from the multicomponent fiber spinning spinneret through a spinning nozzle at a predetermined discharge rate, then is drawn while being cooled using a high-velocity air stream, and is allowed to be oiled on a movable net in the form of a conveyor belt. The web piled on the net may be subjected to hot pressing in order to impart shape stability thereto.

The number of island component portions that are to constitute ultrafine fibers on a cross section of each island-in-the-sea composite fiber is preferably 5 to 200, more preferably 10 to 50, and particularly preferably 10 to 30, because fiber bundles of ultrafine fibers having appropriate voids can be easily formed.

At this time, the melt spinning conditions for the island-in-the-sea composite fibers are preferably as follows. When the discharge rate of molten resin discharged from one hole of the spinning nozzle is represented as A (g/min), the melt specific gravity of the resin as B (g/cm$^3$), the area of one hole as C (mm$^2$), and the spinning rate as D (m/min), conditions set such that the spinning draft calculated by the following expression is in the range of preferably 200 to 500, and more preferably 250 to 400, are preferable in that ultrafine fibers having a fineness of 0.5 dtex or less and a tensile strength of 6 to 9 mN can be easily obtained.

$$\text{Spinning draft}=D/(A/B/C)$$

Examples of the entangling method are as follows. For example, the web is laid in a plurality of layers in the thickness direction using a cross lapper or the like, and is subsequently needle punched simultaneously or alternately from both surfaces thereof such that at least one barb penetrates the web, or the web is subjected to entangling by high-pressure water jetting. The punching density of the needle punching is preferably about 1500 to 5500 punch/cm$^2$, more preferably about 2000 to 5000 punch/cm$^2$, because high abrasion resistance is likely to be achieved. When the punching density is too low, the abrasion resistance tends to be reduced. When the punching density is too high, the fibers tend to be cut, resulting in a reduced degree of entanglement.

An oil solution, an antistatic agent, and the like may be added to the web in any stage from the spinning step to the entangling of the island-in-the-sea composite fibers. In addition, if necessary, the entangled state of the web may be densified in advance by performing shrinking in which the web is immersed in hot water at about 70 to 150° C.

The basis weight of the entangled web obtained by entangling the web is preferably in the range of about 100 to 2000 g/m$^2$. In addition, if necessary, the entangled web may be subjected to a treatment for further increasing the fiber density and the degree of entanglement by heat shrinking the entangled web. For the purpose of, for example, further densifying the entangled web that has been densified by heat shrinking, and fixing the shape of the entangled web or smoothing the surface thereof, the fiber density may be further increased by performing hot rolling with a surface temperature set at 100 to 150° C., or pressing an entangled web heated to an temperature greater than or equal to a softening point of the resin forming the fibers, using a cooling roll set at a surface temperature less than or equal to the softening point, as needed. In particular, performing pressing using a cooling roll set at a surface temperature lower than the softening point by 30° C. or more is particularly preferable, because roe surface is further smoothed.

In the production of the napped artificial leather, an elastic polymer is impregnated into an entangled web obtained by entangling the island-in-the-sea composite fibers before the sea component is removed therefrom, in order to impart shape stability and fullness. By impregnating an elastic polymer in this manner into the entangled web obtained by entangling the island-in-the-sea composite fibers before the sea component is removed therefrom, voids, which are formed as a result of removing the sea component, are formed between ultrafine fibers that form a fiber bundle after removal of the sea component. As a result, the ultrafine fibers inside the fiber bundle are not constrained to each other by the elastic polymer, so that a napped artificial leather having a soft texture is obtained. When an elastic polymer is impregnated into a non-woven fabric of ultrafine fibers forming a fiber bundle, after the sea component has been removed from the island-in-the-sea composite fibers, the elastic polymer enters the voids of the fiber bundle, so that the ultrafine fibers inside the fiber bundle that form the fiber bundle are constrained to each other by the elastic polymer, as a result of which a napped artificial leather having a hard texture is obtained.

Specific examples of the elastic polymer include polyurethane, an acrylonitrile elastomer, an olefin elastomer, a polyester elastomer, a polyamide elastomer, and an acrylic elastomer. Among these, polyurethane is particularly preferable. Specific examples of the polyurethane include polycarbonate urethane, polyether urethane, polyester urethane, polyether ester urethane, polyether carbonate urethane, and polyester carbonate urethane. The polyurethane may be a polyurethane (solvent-based polyurethane) obtained by impregnating the non-woven fabric with a solution in which the polyurethane is dissolved in a solvent such as N,N-dimethylformamide (DMF), and thereafter solidifying the polyurethane by wet coagulation, or may be a polyurethane (aqueous polyurethane) obtained by impregnating the non-woven fabric with an emulsion in which the polyurethane is dispersed in water, and thereafter solidifying the polyurethane by crying. Among these, the solvent-based polyurethane is particularly preferable in that a napped artificial leather having a soft texture is likely to be obtained by suitably dissociating the polyurethane and the ultrafine fibers even when the amount of the polyurethane is increased.

A colorant such as a pigment (e.g., carbon black) or a dye, a coagulation regulator, an antioxidant, an ultraviolet absorber, a fluorescent agent, an antifungal agent, a penetrant, an antifoaming agent, a lubricant, a water-repellent agent, an oil-repellent agent, a thickener, a filler, a curing accelerator, a foaming agent, a water-soluble polymer compound such as polyvinyl alcohol or carboxymethyl cellulose, inorganic fine particles, and a conductive agent may be blended in the elastic polymer, as long as the effects of the present invention are not impaired.

The content ratio of the elastic polymer impregnated into the napped artificial leather is 16 to 40 mass %. By including the elastic polymer at such a ratio, a napped artificial leather having a good balance between the abrasion resistance and the flexible texture can be obtained.

It is preferable that the elastic polymer has an expansion ratio in the range of 0 to 5 mass %. When the elastic polymer is foamed at a high ratio, the elastic polymer surrounds the ultrafine fibers, and therefore the fibers become less likely to fall out, resulting in a further improvement in the pilling resistance. However, it is necessary to adjust additives, or increase the coagulation temperature, so that the manufacturing cost tends to be increased.

By removing the sea component resin from the non-woven fabric obtained by entangling the island-in-the-sea composite fibers, it is possible to obtain an artificial leather substrate including a non-woven fabric that is an entangle body of ultrafine fibers and an elastic polymer impregnated into the non-woven fabric, wherein ultrafine fibers that form a fiber bundle are not constrained by the elastic polymer. As the method for removing the sea component resin from the island-in-the-sea composite fiber, a conventionally known ultrafine fiber formation method such as a method in which a non-woven fabric obtained by entangling island-in-the-sea composite fibers is treated with a solvent or decomposition agent capable of selectively removing oy the sea component resin can be used without any particular limitation.

If necessary, the artificial leather substrate obtained in this manner may be sliced to a predetermined thickness. The basis weight of the artificial leather substrate obtained in this manner is preferably 140 to 3000 g/m$^2$, and more preferably 200 to 2000 g/m$^2$.

Then, by buffing one or both surfaces of the artificial leather substrate, which is a non-woven fabric of ultrafine fibers into which the elastic polymer has been impregnated, a napped artificial leather substrate having a napped surface in which the fibers on the surface layer has been napped is obtained. The buffing is performed using sandpaper or emery paper with a grit number of preferably about 120 to 600, more preferably about 320 to 600. In this manner, a napped artificial leather substrate having a napped surface on which napped fibers are present on one surface or both surfaces is obtained.

For the purpose of improving the appearance quality by making the napped ultrafine fibers on the napped surface less likely to fall out, or making the napped ultrafine fibers less likely to be raised by friction, a solvent capable of swelling or dissolving only the elastic polymer without dissolving the ultrafine fibers may be gravure coated onto the napped surface of the napped artificial leather substrate, thereby fixing the ultrafine fiber bundles by the elastic polymer. By applying the above-described solvent onto the napped surface of the napped artificial leather substrate, the elastic polymer located around the ultrafine fiber bundles is swelled or dissolved, and the elastic polymer enters the gaps in the ultrafine fiber bundles so as to fill the gaps. As the solvent, a solvent capable of swelling or dissolving only the elastic polymer, without dissolving ultrafine fibers made of polyester or polyamide etc., is selected. Specifically, for example, using a solvent mixture of a good solvent for the elastic polymer and a solvent having low dissolving power, the degree of adhesion between the elastic polymer and the ultrafine fibers can be controlled by adjusting the ratio between the good solvent and the solvent having dissolving power.

For example, when the elastic polymer is polyurethane, a liquid mixture is used that includes any given ratio of dimethylformamide (hereinafter, DMF) or tetrahydrofuran (hereinafter, THF) as a good solvent, and an acetone, toluene, cyclohexanone, ethyl acetate, butyl acetate, or the like, which have low dissolving power. The mixing ratio of the good solvent and the solvent having low dissolving power is selected as appropriate within the ratio 10:90 to 90:10 as a weight ratio. The temperature of the solvent when being applied is preferably in the range of 10 to 60° C.

An elastic polymer capable of locally fixing the vicinity of the base of the napped ultrafine fibers may be further applied. Specifically, for example, a solution or an emulsion containing the elastic polymer is applied onto the napped surface, follow by drying, to solidify the elastic polymer. By applying the elastic polymer capable of locally fixing the vicinity of the base of the napped ultrafine fibers present on the napped surface, the vicinity of the base of the fibers present on the napped surface is constrained by the elastic polymer, thus making the ultrafine fibers less likely to fall out. As the specific example of the elastic polymer that is applied into the napped surface, the same elastic polymers as those described above can be used. The amount of the elastic polymer applied into the napped surface is preferably 1 to 10 g/m$^2$, and more preferably 2 to 8 g/m$^2$, because the vicinity of the base of the ultrafine fibers can be firmly fixed without making the napped surface too hard.

Note that the ultrafine fibers being fixed by the elastic polymer means that the elastic polymer fixes the ultrafine fibers so as to constrain the ultrafine fibers, when a cross section of the napped artificial leather in the thickness direction is observed with a scanning electron microscope. The surface layer portion means a region in which the elastic polymer capable of locally fixing the vicinity of the base of the ultrafine fibers is applied. Specifically, this region is a region extending, from the base of the napped fibers in the thickness direction, a distance corresponding to 10% or less, and more preferably 5% or less of the overall thickness of the napped artificial leather. Note that the overall thickness of the napped artificial leather is the thickness excluding the napped fibers The napped artificial leather substrate having a napped surface may be further subjected to shrinkage processing treatment or flexibilizing treatment by crumpling for imparting flexibility to adjust the texture, or may be subjected to finishing treatment such as reverse seal brushing treatment, antifouling treatment, hydrophilization treatment, lubricant treatment, softener treatment, antioxidant treatment, ultraviolet absorber treatment, fluorescent agent treatment, flame retardant treatment, or the like.

The napped artificial leather substrate having a napped surface is dyed, and thus is finished into a napped artificial leather. As the dye, a suitable dye is selected as appropriate according to the type of the ultrafine fibers. For example, when the ultrafine fibers are made from a polyester-based resin, it is preferable that the artificial leather substrate is dyed with a disperse dye or a cation dye. Specific examples of the disperse dye include benzene azo-based dyes (e.g., monoazo and disazo), heterocyclic azo-based dyes (e.g., thiazole azo, benzothiazole azo, quinoline azo, pyridine azo, imidazole azo, and thiophene azo), anthraquinone-based dyes, and condensate-based dyes (e.g., quinophthalone, styryl, and coumarin). These are commercially available as dyes with the prefix "Disperse", for example. These may be used alone or in a combination of two or more. As the dyeing method, it is possible to use a high-pressure jet dyeing method, a jigger dyeing method, a thermosol continuous dyeing machine method, a dyeing method using a sublimation printing process, and the like, without any particular limitation.

In this manner, a napped artificial leather according to the present embodiment is obtained. The ultrafine fibers that form a non-woven fabric included in the napped artificial leather have a fineness of 0.5 dtex or less, and a tensile strength of 6 to 9 mN. By including a non-woven fabric made of fiber bundles of such ultrafine fibers, a napped artificial leather having a combination of an elegant napped appearance, high abrasion resistance, high colour fastness to rubbing, and a soft texture can be obtained.

The ultrafine fibers that form the non-woven fabric have a fineness of 0.5 dtex or less, preferably 0.07 to 0.5 dtex, more preferably 0.1 to 0.3 dtex, and particularly preferably 0.15 to 0.25 dtex. When the fineness of the ultrafine fibers exceeds 0.5 dtex, it becomes difficult to obtain an elegant napped appearance. When the fineness of the ultrafine fibers is too low, the abrasion resistance tends to deteriorate. Note that the fineness is determined as an average value of fineness of 15 evenly selected fibers and a fineness is calculated by using the diameter and the density of the resin for forming the fiber, and the diameter is measured, using a scanning electron microscope (SEM) at a magnification of 3000×, by imaging a cross section of the napped artificial leather that is parallel to the thickness direction thereof.

The ultrafine fibers that forms the non-woven fabric have a tensile strength of 6 to 9 mN, and preferably 6.5 to 8 mN. When the tensile strength of the ultrafine fibers is less than 6 mN, the ultrafine fibers on the napped surface tend to be too easily cut. Accordingly, the napped fibers tend to ne fluffed off when the napped surface is rubbed by another article, and the fluff contaminates the other article resulting in a reduction in the colour fastness to rubbing (crocking fastness). When the tensile strength of the ultrafine fibers exceeds 9 mN, the ultrafine fibers on the napped surface tend to be too difficult to cut. Accordingly, during buffing for forming the napped surface in the manufacturing process of the napped artificial leather, the napped ultrafine fibers become too long to obtain an elegant napped appearance, or the ultrafine fibers tend to be difficult to cut when the napped surface is rubbed by another article, resulting in a reduction in the pilling resistance.

The tensile strength of the ultrafine fibers is a tensile strength per ultrafine fiber that forms the napped artificial leather. As will be described below, this tensile strength is a maximum stress when an s-s curve per ultrafine fiber is measured in a tensile strength mode at a crosshead speed of 1 mm/min, using Micro Auto Graph, and is an average value of maximum stresses determined when measuring five ultrafine fibers.

The apparent density of the napped artificial leather is 0.38 g/cm$^3$ or more, preferably 0.4 g/cm or more, more preferably 0.4 to 0.7 g/cm$^3$, particularly preferably 0.4 to 0.5 g/cm$^3$, and quite particularly preferably 0.4 to 0.48 g/cm$^3$. With such an apparent density, a napped artificial leather has a good balance between the fullness that does not cause sharp bending, and a soft texture. When the apparent density of the napped artificial leather is less than 0.38 g/cm$^3$, sharp bending tends to occur due to a low level of fullness. Furthermore, the fibers tend to be easily pulled out when the napped surface is rubbed, and an elegant napped appearance is less likely to be obtained. When the apparent density of the napped artificial leather is too high, a soft texture is less likely to be obtained.

Preferably, in the napped artificial leather of the present embodiment, the tensile strength of the ultrafine fibers is a tensile strength A (mN) in the range of 6.5 to 8 mN, the apparent density of the napped artificial leather is 0.38 to 0.48 g/cm$^3$, and the content ratio B of the elastic polymer satisfies $3.125 \times A \leq B$.

As will be shown in the examples described below, when the content ratio of the elastic polymer satisfies the relational expression: $3.125 \times A \leq B$, in relation to the tensile strength A (mN) of the Ultrafine fibers that is in the range of 6.5 to 8 mN, and the apparent density of the napped artificial leather is 0.38 to 0.48 g/cm$^3$, a napped artificial leather having particularly high pilling resistance can be obtained.

EXAMPLES

Hereinafter, the present invention will be described more specifically by way of examples. It should be noted the the scope of the present invention is not to be construed as being limited to the examples.

First, the evaluation methods used in the present examples will be collectively described below.

<Fineness>

The fineness was determined by measuring the cross-sectional areas of randomly selected 15 cross sections of an ultrafine fiber observed in an image of a cross section of a napped artificial leather in the thickness direction, captured with a scanning electron microscope (SEM) at 3000×, calculating an average value of the cross-sectional areas, and converting the value into a fineness based on the density of each resin.

<Tensile Strength>

Figure 1B:
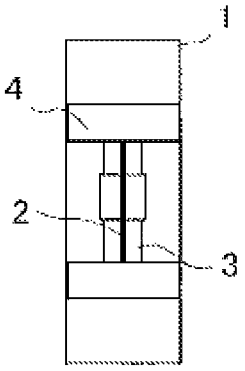
FIG. 1B shows part of an illustrated method for measuring the tensile strength of ultrafine fibers, where the ultrafine fiber is fixed to the mold frame.
Figure 1C:
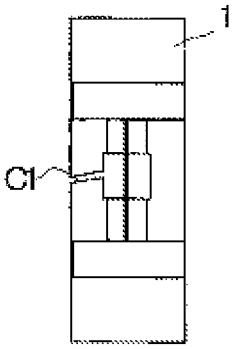
FIG. 1C shows part of an illustrated method for measuring the tensile strength of ultrafine fibers, where a frame that formed the window of the mold frame is cut.
Figure 1D:
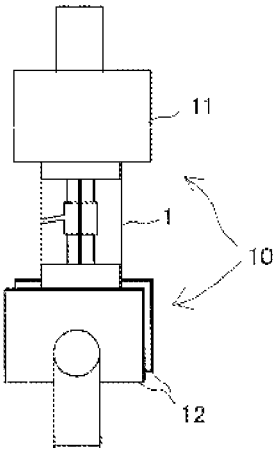
FIG. 1D shows part of an illustrated method for measuring the tensile strength of ultrafine fibers. where the upper and lower frames of the mold frame are held by upper and lower chucks.
Figure 1E:
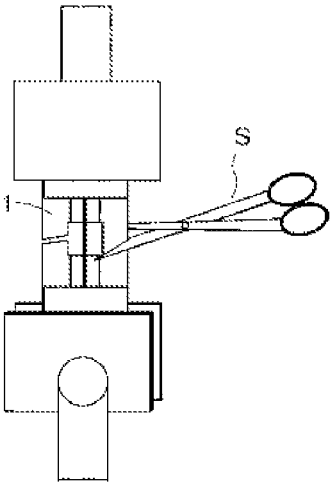
FIG. 1E shows part of an illustrated method for measuring the tensile strength of ultrafine fibers, where the other frame that formed the window of the mold frame is being cut.
Figure 1F:
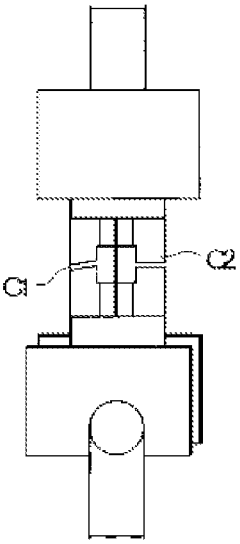
FIG. 1F shows part of an illustrated method for measuring the tensile strength of ultrafine fibers, where the other frame that formed the window of the mold frame is cut.
Figure 1G:
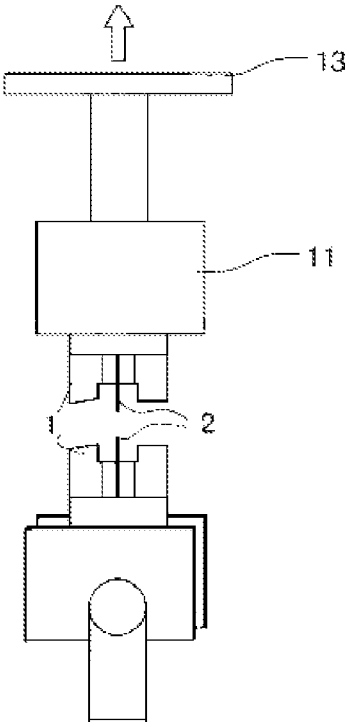
FIG. 1G shows part of an illustrated method for measuring the tensile strength of ultrafine fibers, where an s-s curve was formed by measuring stress applied when a crosshead was raised.

At Shimadzu Techno-Research, Inc., the tensile strength of one ultrafine fiber was measured using the following method. First, a mold frame 1 obtained by cutting out a rectangular window W with a height of 1 mm in a central portion of cardboard 1 as shown in FIG. 1A was prepared. Meanwhile, from a cut piece of each artificial leather, an ultrafine fiber 2 forming the non-woven fabric and having a length of 3 mm or more were collected. Then, as shown in FIG. 1B, the ultrafine fiber 2 was fixed to the mold frame 1 using an adhesive agent 3 and adhesive tape 4 such that the ultrafine fiber 2 perpendicularly passed through the central portion of the window W. Then, as shown in FIG. 1C, one frame C1 that formed the window W of the mold frame 1 was cut with scissors. Then, as shown in FIG. 1D, upper and lower frames of the mold frame 1 were respectively held by upper and lower chucks 11 and 12 of Micro Auto Graph 10 (MST-X HR-U 0.5 N kit (manufactured by SHIMADZU CORPORATION)) with an interchuck distance of 1 cm, under an atmosphere of 23° C. and 50% RH. Then, as shown in FIG. 1E and FIG. IF, the other frame C2 that formed the window W of the mold frame 1 was also cut with scissors S. Then, as shown in FIG. 1G, an s-s curve was formed by measuring the stress applied when a crosshead 13 of Micro Auto Graph 10 was raised at a speed of 1 mm/min. The point at which the s-s curve started rising was defined as the zero point. Then, a maximum stress on the s-s curve was determined, and an average value of maximum stresses of the five ultrafine fibers was determined as the tensile strength.

<Elastic Polymer Content Ratio>

The weight (W1) of 10 g of a fragment of the napped artificial leather was measured. Then, a process of immersing the fragment in dimethylformamide for a certain period of time, and subsequently pressing the fragment was repeatedly performed, to extract the elastic polymer, which was polyurethane. Then, the non-woven fabric, which was the remainder after the extraction, was dried, and the weight (W2) of the dried non-woven fabric was measured. Then, the elastic polymer content ratio was calculated from the expression:

$$\text{Elastic polymer content ratio}(B)=(W1-W2)/W1\times 100\ (\%)$$

<Apparent Density>

The thickness (mm) and the basis weight (g/cm$^2$) were measured in accordance with JIS L 1913, and the apparent density (g/cm$^3$) was calculated from the measured values.

<Expansion Ratio of Elastic Polymer (Polyurethane)>

Images of three average locations of a portion 300 μm away from the surface of a cross section of the napped artificial leather parallel to the thickness direction were captured using a scanning electron microscope (SEM) at 300×, and each of the three images was printed on an A4 sheet of paper. Then, the printed sheets were placed on top of an OHP (Overhead projector) sheet. Then, the foamed portions of the polyurethane, which was the elastic polymer, were blackened, and transferred onto the OHP sheet. At this time, voids that included the fibers therein were considered to be voids formed when removing the sea component from the island-in-the-sea composite fiber, and were therefore not determined as formed portions, and only independent voids that did not include any fibers therein were determined as foamed portions. Then, the pattern on the OHP sheet on which the foamed portions had been blackened was captured with a scanner, to form an image.

In addition, the printed sheets were placed on top of an OHP sheet, and all regions in which the polyurethane including the foamed portions was present were blackened and transferred onto the ORB sheet. Then, the OP sheet on which all regions in which the polyurethane including the foamed portions was present were blackened was captured with a scanner, to form an image.

Then, using an image processing device (Image-pro plus, manufactured by Media Cybernetics, Inc.), the total area of the blackened portions in all the regions in which the polyurethane was present was determined from the obtained images. In addition, the total area of the blackened portions of the foamed portions was measured.

Then, from the total area of the blackened portions in all the regions in which the polyurethane was present, and the total area of the foamed portions of the blackened portions, the expansion ratio of the polyurethane was calculated by the expression:

$$\text{Polyurethane expansion ratio (\%)}=\text{Total area of foamed portions of blackened portions/Total area of blackened portions in all regions in which polyurethane was present}\times 100$$

<Intrinsic Viscosity of Resin for Forming Ultrafine Fibers>

As for the intrinsic viscosity of the resin for forming the ultrafine fibers, a solution was prepared by dissolving the resin in a phenol/tetrachloroethane (volume ratio 1/1) solvent mixture as a solvent, and the viscosity of the solution was measured at 30° C. using an Ubbelohde's viscometer (model "HRK-3" manufactured by Hayashi Seisakusho Co., Ltd.), to determine an intrinsic viscosity.

<Spinning Draft>

The discharge rate of the molten resin discharged from one hole of a spinning nozzle was represented as A (g/min), the resin melt specific gravity as B (g/cm$^3$), the area of one hole as C (mm$^2$), and the spinning rate as D (m/min), the spinning draft was calculated by the following expression.

$$\text{Spinning draft}=D/(A/B/C)$$

<Crocking>

The crocking in a dry state and a wet state was measured using an Atlas clockmeter CM-5 (manufactured by ATLAS ELECTRIC DEVICES Co.).

The crocking fastness in a dry state was measured as follows.

A dry white cotton cloth was attached to a glass friction element. The white cotton cloth attached to the friction element was brought into contact with the napped surface of the napped artificial leather under a load of 900 g, and was reciprocated 10 times. Then, the white cotton cloth was removed, cellophane tape (Cellotape, registered trademark) was attached onto the resulting contaminated portion, and a columnar load of 1.5 ponds was rolled thereon in one reciprocating movement. Thereafter, the cellophane tape was detached from the white cotton cloth.

On the other hand, the crocking fastness in a wet state was measured as follows.

A wetted white cotton cloth that had been immersed in distilled water and from which excess water had been thereafter removed was attached to a class friction element. The white cotton cloth attached to the friction element was brought into contact with the napped surface of the napped artificial leather under a load of 900 g, and was reciprocated 10 times. Then, the white cotton cloth was removed and dried at 60° C. or less, and thereafter cellophane tape was attached onto the resulting contaminated portion, and a columnar load of 1.5 ponds was rolled thereon in one reciprocating movement Thereafter, the cellophane tape was detached from the white cotton cloth.

Then, as the crocking fastness in a dry state and a wet state, the change in color of the white cotton cloth was evaluated using a Grey scale for assessing staining (grades 5 to 1).

<Colour Fastness to Rubbing>

Using a Gakushin type rubbing tester, a white cloth in accordance with JIS L 0803 was prepared, and a friction element to which the white cloth was attached was reciprocated 30 times per minute for a traveling distance of 10 cm under a load of 200 g, to rub the surface of a measuring piece, and measurement was performed 100 times (in accordance with JIS L 0849). The degree of color staining caused in the white cloth after performing the measurement 100 times was compared with a Grey scale for assessing staining (in accordance with JIS L 0805) and evaluated as the degree of color staining under a dry condition. In the measurement under a wet condition, in accordance with JIS L 0849 9.1b, the white cloth was immersed in distilled water for 10 minutes or longer and thereafter removed, and excess water was removed from the white cloth using filter paper. Using the white cloth from which water no longer dripped, measurement was performed by the same method as used for a dry condition, and the same evaluation was performed as in the case of dry condition.

<Pilling Resistance>

The napped artificial leather that had been subjected to testing in accordance with JIS L 1096 (6.17.5E method, Martindale method) under a pressing load of 12 kPa for 5000 abrasion cycles, using a Martindale abrasion tester, was graded according to the following criteria.

5: No change was observed.

4: A slight amount of pilling with a maximum diameter of less than 1 mm occurred.

3: Pilling with a maximum diameter of 1 to 3 mm occurred.

2: Pilling with a maximum diameter of 3 to 5 mm occurred.

1: A large amount of pilling with a maximum diameter exceeding 5 mm occurred.

<Abrasion Loss>

The abrasion loss of the napped artificial leather was measured by subjecting the napped artificial leather to an abrasion test in accordance with JIS L 1096 (8.17.5E method, Martindale method) under a pressing load of 12 kPa (gf/cm$^2$) for 50000 abrasion cycles, using a Martindale abrasion tester.

<Softness>

The softness was measured using a softness tester (leather softness measuring instrument ST 300, manufactured by MSA Engineering Systems limited of the United Kingdom). Specifically, a predetermined ring with a diameter of 25 mm was set on a lower holder of the instrument, and thereafter, the napped artificial leather was set on the lower holder. Then, a metal pin (diameter: 5 mm) fixed to an upper lever was pressed down toward the napped artificial leather. Then, the upper lever was pressed down, the value at which the upper lever was locked was measured at five different locations, and the average value was read, Note that the value indicated the depression depth, and a larger value indicated higher suppleness.

<Texture>

The obtained napped artificial leather was bent, and the elasticity and the touch of flexibility were evaluated according to the following criteria.

A: A texture with fullness and excellent flexibility without any sharp bending.

B: A texture corresponding to one or more of a texture lacking fullness, a texture causing sharp bending, and a hard texture.

<Appearance>

The appearance of the obtained napped artificial leather was evaluated through visual inspection and tactile impression according to the following criteria.

A: A napped surface having a soft and smooth touch, with finely loosened fibers with a uniform length.

B: A napped surface having a rough touch and no writing, with roughly loosened fibers with a nonuniform length.

Example 1

Polyethylene (PE) having a melt flow rate (MFR) of 25 (g/10 min, 190° C.) was prepared as a sea component resin, and a composition obtained by adding 1.0 mass % of carbon black (CB) to polyethylene terephthalate (PET) having an intrinsic viscosity [η]=0.67 (dl/g) and a melting point of 251° C. was prepared as an island component resin. Then, melt spinning was performed at 285° C. such that the ratio of sea component/island component was 35/65 (mass ratio). Specifically, the resins were discharged from a spinning spinneret having a nozzle diameter (pore diameter) of 0.40 mm at a throughput per hole of 1.5 g/min, the ejector pressure was adjusted such that the spinning rate was 3450 in/min, and the resulting filaments were collected on a net. By spinning the filaments at a spinning draft of 279, a web of island-in-the-sea composite fibers having a fineness of 4.3 dtex was obtained.

Then, layers of the obtained web were stacked, to form a stacked web. Then, the stacked web was needle-punched using 6-barb needles at a punching density of 2020 P/cm$^2$, to form an entangled fiber sheet having a basis weight of 810 g/m$^2$.

Then, the entangled fiber sheet was shrunk in hot water at 90° C., dried, and thereafter hot-pressed, thereby obtaining a heat-shrunk entangled fiber sheet having a basis weight of 912 g/m$^2$, an apparent density of 0.389 g/cm$^3$, and a thickness of 2.35 mm.

Then, the heat-shrunk entangled fiber sheet was impregnated with a DMF solution (solid content: 18.5 mass %) of a polycarbonate-based non-yellowing polyurethane having a 100% modulus of 4.5 MPa serving as an elastic polymer such that the ratio of the elastic polymer to the napped artificial leather was 32 mass %, and thereafter the heat-shrunk entangled fiber sheet was immersed in a 30% aqueous DMF solution at 40° C., to coagulate the polyurethane.

Next, the entangled fiber sheet into which the polyurethane had been applied was immersed in toluene at 85° C., while being subjected to nipping, to remove the PE serving as the sea component, and the entangled fiber sheet was further dried. In this manner, an artificial leather substrate having a basis weight of 837 g/m$^2$, an apparent density of 0.437 g/cm$^3$, and a thickness of 1.91 mm was obtained that was a composite of the polyurethane, and the non-woven fabric that was an entangle body of fiber bundles of ultrafine fibers of the BET filaments. Since the non-woven fabric of the ultrafine fibers was formed by removing the sea component after impregnating the polyurethane into the non-woven fabric, the ultrafine fibers in the fiber bundles are not fixed to each other by the polyurethane, and are not constrained by the polyurethane.

Then, after slicing the artificial leather substrate in half, a solvent mixture of DMF/cyclohexanone=30/70 (weight ratio) was applied to a main surface that was to form a napped surface, and thereafter dried, to fix the polyurethane to the ultrafine fibers in the surface layer portion of artificial leather substrate. Thereafter, both surfaces of the half-slice artificial leather substrate were buffed, using a paper with a grit number of 120 for the back surface and papers with grit numbers of 320 and 600 for the main surface, whereby the artificial leather substrate was finished into an artificial leather substrate with a napped surface formed thereon. Then, the artificial leather substrate with a napped surface formed thereon was subjected to high-pressure dyeing at 120° C. using a disperse dye, thereby obtaining a napped artificial leather having a suede-like napped surface. Then, the napped artificial leather was evaluated according to the above-described evaluation methods. The results are shown in Table 1.

TABLE 1

| Example No. | Ex. 1 | Ex. 2 | Ex. 3 | Ex. 4 | Ex. 5 | Ex. 6 | Com. Ex. 1 |
|---|---|---|---|---|---|---|---|
| Island component resin | PET | PET | PET | PET | PET | PET | PET |
| Intrinsic viscosity (dl/g) | 0.57 | 0.62 | 0.59 | 0.67 | 0.67 | 0.67 | 0.59 |
| Melting point (° C.) | 251 | 250 | 249 | 251 | 251 | 251 | 240 |
| CB content ratio (%) | 1.0 | 1.0 | 1.0 | 0 | 1.0 | 1.0 | 1.0 |
| Sea component resin | PE | PE | PE | PE | PE | PE | PE |

TABLE 1-continued

| | | | | | | | |
|---|---|---|---|---|---|---|---|
| Melting point (° C.) | 109 | 109 | 109 | 109 | 109 | 109 | 109 |
| MFR (g/10 min, PE 190° C., PVA 230° C.) | 25 | 25 | 25 | 25 | 25 | 25 | 25 |
| Sea/Island melting point difference (° C.) | 142 | 141 | 140 | 142 | 142 | 142 | 131 |
| Number of islands (islands) | 12 | 12 | 6 | 12 | 12 | 12 | 12 |
| Sea/Island ratio (%) | 35/65 | 35/65 | 35/65 | 35/65 | 35/65 | 35/65 | 35/65 |
| Nozzle diameter (mm) | 0.4 | 0.4 | 0.4 | 0.4 | 0.4 | 0.4 | 0.4 |
| Throughput per hole (g/min) | 1.5 | 1.5 | 1.5 | 1.2 | 1.5 | 1.5 | 1.5 |
| Spinning rate (m/min) | 3450 | 3200 | 3570 | 3100 | 3450 | 3450 | 3900 |
| Spinning draft | 279 | 259 | 289 | 337 | 279 | 279 | 315 |
| Application of solvent or polyurethane solution onto surface after half slicing | Done | Done | Done | Done | Done | Not done | Done |
| Fineness (dtex) | 0.22 | 0.20 | 0.41 | 0.21 | 0.23 | 0.22 | 0.21 |
| Tensile strength (mN) | 7.8 | 6.6 | 7.7 | 7.7 | 7.5 | 7.7 | 5.2 |
| Elastic polymer ratio (%) | 32 | 29 | 30 | 18 | 37 | 31 | 31 |
| Basis weight (g/m$^2$) | 332 | 340 | 336 | 349 | 377 | 336 | 348 |
| Thickness (mm) | 0.82 | 0.80 | 0.80 | 0.80 | 0.82 | 0.82 | 0.79 |
| Apparent density (g/cm$^3$) | 0.405 | 0.427 | 0.420 | 0.438 | 0.460 | 0.410 | 0.440 |
| Crocking (Dry, grade) | 4-5 | 4-5 | 4 | 4-5 | 4 | 4 | 4-5 |
| (Wet, grade) | 4 | 4-5 | 4 | 3-4 | 4 | 4 | 3 |
| Colour fastness to rubbing (Dry, grade) | 4-5 | 4-5 | 4-5 | 4-5 | 4-5 | 4-5 | 4 |
| (Wet, grade) | 3-4 | 3-4 | 3-4 | 4 | 3-4 | 3-4 | 2-3 |
| Abrasion loss (mg) | 27.5 | 37.8 | 32.0 | 31.5 | 23.2 | 35.4 | 65.2 |
| Softness (mm) | 4.4 | 4.1 | 4.1 | 4.7 | 4.2 | 4.1 | 3.8 |
| Texture | A | A | A | A | A | A | A |
| Appearance | A | A | A | A | A | A | A |

| Example No. | Com. Ex. 2 | Com. Ex. 3 | Com. Ex. 4 | Com. Ex. 5 | Com. Ex. 6 | Com. Ex. 7 |
|---|---|---|---|---|---|---|
| Island component resin | PET | PET | PET | PET | PET | PET |
| Intrinsic viscosity (dl/g) | 0.72 | 0.62 | 0.67 | 0.67 | 0.59 | 0.67 |
| Melting point (° C.) | 252 | 250 | 251 | 251 | 240 | 251 |
| CB content ratio (%) | 1.0 | 1.0 | 1.0 | 1.0 | 0 | 1.0 |
| Sea component resin | PE | — | PE | PE | PVA | PVA |
| Melting point (° C.) | 109 | — | 109 | 109 | 206 | 206 |
| MFR (g/10 min, PE 190° C., PVA 230° C.) | 25 | — | 29 | 29 | 83 | 83 |
| Sea/Island melting point difference (° C.) | 143 | 250 | 142 | 142 | 34 | 45 |
| Number of islands (islands) | 12 | 1 | 12 | 12 | 12 | 12 |
| Sea/Island ratio (%) | 35/65 | 0/100 | 35/65 | 35/65 | 25/75 | 25/75 |
| Nozzle diameter (mm) | 0.4 | 0.25 | 0.4 | 0.4 | 0.4 | 0.4 |
| Throughput per hole (g/min) | 1.5 | 0.167 | 1.5 | 1.5 | 1.0 | 1.0 |
| Spinning rate (m/min) | 3600 | 3000 | 3450 | 3450 | 3300 | Unspinnable |
| Spinning draft | 291 | 694 | 279 | 279 | 493 | |
| Application of solvent or polyurethane solution onto surface after half slicing | Done | Done | Done | Done | Done | |
| Fineness (dtex) | 0.22 | 0.56 | 0.21 | 0.22 | 0.11 | |
| Tensile strength (mN) | 9.3 | 21 | 6.5 | 6.4 | 5.3 | |
| Elastic polymer ratio (%) | 30 | 32 | 15 | 43 | 10 | |
| Basis weight (g/m$^2$) | 336 | 351 | 320 | 413 | 398 | |
| Thickness (mm) | 0.81 | 0.81 | 0.80 | 0.77 | 0.92 | |
| Apparent density (g/cm$^3$) | 0.415 | 0.433 | 0.400 | 0.536 | 0.435 | |
| Crocking (Dry, grade) | 4-5 | 4-5 | 4-5 | 4-5 | 3 | |
| (Wet, grade) | 4-5 | 4 | 4 | 4 | 1-2 | |
| Colour fastness to rubbing (Dry, grade) | 4-5 | 4-5 | 4-5 | 4-5 | 3 | |
| (Wet, grade) | 4 | 4 | 3-4 | 3-4 | 1 | |
| Abrasion loss (mg) | 20.2 | 21.4 | 53.3 | 15.5 | 76.8 | |
| Softness (mm) | 4.1 | 3.1 | 4.3 | 4.2 | 3.5 | |
| Texture | A | B | A | A | B | |
| Appearance | B | B | B | B | A | |

Examples 2 to 6, Comparative Examples 1 to 5

In Examples 2 to 5 and Comparative Examples 1, 2, 4, and 5, napped artificial leathers were obtained and evaluated in the same manner as in Example 1 except that the fineness and the tensile strength of the ultrafine fibers were chanced as shown in Table 1 by setting the intrinsic viscosity or the melting point of the PET, or the spinning condition of the island-in-the-sea composite fibers. In Example 6, a napped artificial leather was produced and evaluated in the same manner as in Example 1 except for omitting the process of applying the solvent mixture of DMF/cyclohexanone=30/70 (weight ratio) to the main surface that was to form the napped surface, and drying the solvent mixture. Comparative Example 3 is an example in which the entangle body of ultrafine fibers was formed by directly spinning ultrafine fibers, and the ultrafine fibers were constrained to each other by the elastic polymer. The results are shown in Table 1.

Comparative Example 6

A water-soluble polyvinyl alcohol resin (PVA; sea component), and an isophthalic acid-modified polyethylene terephthalate (island component) having an intrinsic viscosity [η]=0.59 (dl/g), a melting point of 240° C., and a degree of modification of 6 mol % were prepared. Then, the resins were discharged from a spinneret (number of islands: 12 islands/fiber) for composite melt-spinning at 260° C. at a throughput per hole of 1.0 g/min such that the ratio of sea component/island component was 25/75 (mass ratio). Then, the ejector pressure was adjusted such that the spinning rate was 3300 m/min, and the resulting filaments having a fineness of 3.0 dtex were collected on a net, to obtain a web of island-in-the-sea composite fibers.

Layers of the obtained web were stacked by cross wrapping, to obtain a superposed body, and oil solution for preventing the needle from breaking was sprayed thereto. Next, the superposed body was needle-punched using 1-barb 42-gauge needles and 6-barb 42-gauge needles, to achieve entanglement, and thereby to obtain an entangled fiber sheet.

Next, the entangled fiber sheet was subjected to steam treatment at 110° C. and 23.5% RH. Then, the entangled fiber sheet was dried in an oven at 90 to 110° C., and was thereafter further hot-pressed at 115° C., thereby obtaining a heat-shrunk entangled fiber sheet.

Next, the heat-shrunk entangled fiber sheet was impregnated with an emulsion (solid content: 40 mass %) of a polycarbonate-based non-yellowing polyurethane having a 100% modulus of 4.5 MPa serving as an elastic polymer such that the content ratio of the elastic polymer to the napped artificial leather was 10 mass %, and thereafter the polyurethane was dry-coagulated. Next, the entangled fiber sheet into which the polyurethane had been applied was immersed in hot water at 95° C. for 10 minutes wile being subjected to nipping and high-pressure water jetting, to remove the PVA serving as the sea component, and was further dried. In this manner, an artificial leather substrate having a fineness of 0.11 dtex and an apparent density of 0.435/cm$^3$ was obtained that was a composite of the polyurethane, and the non-woven fabric that was the entangle body of fiber bundles of the ultrafine fibers of filaments.

Next, after slicing the artificial leather substrate in half, a DMF solution (solid content: 5%) of polyurethane was applied to a main surface that was to form a napped surface, and thereafter dried, to fix the polyurethane to the ultrafine fibers in the surface layer portion of the artificial leather substrate. Thereafter, both surfaces of the half-slice artificial leather substrate were ground at a speed or 3.0 m/min and a rotation rate of 650 rpm, using a paper with a grit number of 120 for the back surface, and papers with grit numbers of 240, 320, and 600 for the main surface, whereby an artificial leather substrate having a napped surface was obtained. Then, the artificial leather substrate with a napped surface formed thereon was subjected to high-pressure dyeing at 120° C. using a disperse dye, thereby obtaining a napped artificial leather having a suede-like napped surface. Then, the napped artificial leather was evaluated according to the above-described evaluation methods. The results are shown in Table 1.

Comparative Example 71

In Comparative Example 6, an attempt was made to produce a napped artificial leather in the same manner as in Comparative Example 6 except that an isophthalic acid-modified polyethylene terephthalate having an intrinsic viscosity [η]=0.67 (dl/g), a melting point of 251° C., and a degree of modification of 6 mol % was used in pace of the isophthalic acid-modified polyethylene terephthalate having an intrinsic viscosity [η]=0.59 (dl/g), a melting point of 240° C., and a degree of modification of 6 mol %. However, the resins were unspinnable due to poor stability in melt spinning.

Referring to Table 1, all of the napped artificial leathers of Examples 1 to 6, each of which included a non-woven fabric including ultrafine fibers having a fineness of 0.5 dtex or less and a tensile strength of 6 to 9 mN, and the content ratio of the elastic polymer is in the range of 16 to 40 mass %, had an appearance evaluated as A, and thus had an elegant napped appearance. All of the napped artificial leathers of Examples 1 to 6 had a crocking of grade 4 or higher in a dry state, and a crocking of grade 3-4 or higher in a wet state, and a colour fastness to rubbing of grade 4-5 under a dry condition, and a colour fastness to rubbing of grade 3-4 or higher under a wet condition, and thus had high colour fastness to rubbing. All of the napped artificial leathers of Examples 1 to 6 had high abrasion resistance of an abrasion loss of 40 mg or less. Furthermore, all of the napped artificial leathers of Examples 1 to 6 had a softness of 4.0 mm or more, and thus had a soft texture. As such, all of the napped artificial leathers of Examples 1 to 6, in each of which the ultrafine fibers had a fineness of 0.5 dtex or less and a tensile strength of 6 to 9 mN, the content ratio of the elastic polymer was 16 to 40 mass %, and the ultrafine fibers that formed fiber bundles were not constrained by the elastic polymer in a region of the napped artificial leather other than the surface layer portion, were napped artificial leathers having a combination of an elegant napped appearance, high abrasion resistance, high colour fastness to rubbing, and a soft texture.

On the other hand, the napped artificial leather of Comparative Example 1, which included the non-woven fabric including ultrafine fibers having a tensile strength of less than 6 mN, despite having a fineness of 0.5 dtex or less, had low abrasion resistance of an abrasion loss of 65.2 mg, a crocking of grade 3 in a wet state, and low colour fastness to rubbing of grade 2-3 under a wet condition. The napped artificial leather of Comparative Example 2, which included the non-woven fabric including ultrafine fibers having a tensile strength exceeding 9 mN, despite having a fineness of 0.5 dtex or less, had an appearance evaluated as B, and therefore did not have an elegant napped appearance. The napped artificial leather of Comparative Example 3, which included the non-woven fabric including ultrafine fibers having a fineness exceeding 0.5 dtex and a tensile strength of 21 mN, and in which the ultrafine fibers were constrained by the elastic polymer, had an appearance evaluated as B, and therefore also did not have an elegant napped appearance. The napped artificial leather of Comparative Example 4, which included the non-woven fabric including ultrafine fibers having a fineness of 0.5 dtex or less and a tensile strength of 6.5 mN, but in which the ratio of the elastic polymer was 15 mass %, had a certain level of abrasion resistance of an abrasion loss of 53.3 mg, but had an appearance evaluated as B, and therefore did not also have an elegant napped appearance. The napped artificial leather of Comparative Example 5, which included the non-woven fabric including ultrafine fibers having a fineness of 0.5 dtex or less and a tensile strength of 6.4 mN, but in which the ratio of the elastic polymer was 43 mass %, had an appearance evaluated as B, and therefore did not also have an elegant napped appearance. The napped artificial leather of Comparative Example 6, which included the non-woven fabric having a fineness of 0.5 dtex or less and a tensile strength of 5.3 mN, but included in which the ratio of the elastic polymer was 10 mass %, had low abrasion resistance of an abrasion loss of 76 mg, a crocking of grade 1-2 in a wet state, and low colour fastness to rubbing of grade 1 under a wet condition.

Example 7

Polyethylene (PE) having a melt flow rate (MFR) of 25 (g/10 min, 190° C.) was prepared as a sea component, and a composition obtained by adding 1.0 mass % of carbon black (CB) to polyethylene terephthalate (PET) having an intrinsic viscosity [η]=0.67 (dl/g) and a melting point of 2.51° C. was prepared as an island component. Then, melt spinning was performed at 260° C. such that the ratio of sea component/island component was 35/65 (mass ratio). Specifically, the resins were discharged from a spinning spinneret (number of islands: 12 islands/fiber) having a pore diameter of 0.40 mm at a throughput per hole of 1.5 g/min, the ejector pressure was adjusted such that the spinning rate was 3450 m/min, and the resulting filaments were collected on a net. By spinning the filaments at a spinning draft of 279, a web of island-in-the-sea composite fibers having a fineness of 4.5 dtex was obtained.

Then, layers of the obtained web were stacked by cross wrapping so as to have a total basis weight of 600 g/m$^2$, to form a stacked web. Then, the superposed body was needle-punched at 4189 punch/cm$^2$ using 1-barb 42-gauge needles and 6-barb 42-gauge needles, to achieve entanglement, and thereby to form an entangled fiber sheet having a basis weight of 840 g/m$^2$.

Then, the entangled fiber sheet was shrunk in hot water at 90° C., then dried in an oven at 90 to 110° C., and thereafter pressed with a roll, thereby obtaining a heat-shrunk web entangled sheet having a basis weight of 940 g/m$^2$, an apparent density of 0.40 g/cm$^3$, and a thickness of 2.35 mm.

Then, the heat-shrunk entangled fiber sheet was impregnated with a DMF solution (solid content: 18.5%) of a polycarbonate-based non-yellowing polyurethane having a 100% modulus of 3.2 MPa serving as an elastic polymer such that the content ratio of the polyurethane to the napped artificial leather was 32 mass %, and thereafter the heat-shrunk entangled fiber sheet was immersed in a 30% aqueous DMF solution at 40° C., to coagulate the polyurethane.

Next, the entangled fiber sheet into which the polyurethane had been applied was immersed in toluene at 90° C., while being subjected to nipping, to remove the PE serving as the sea component, and the entangled fiber sheet was further dried. In this manner, an artificial leather substrate having a basis weight of 810 g/m$^2$, an apparent density of 0.458 g/cm$^3$, and a thickness of 1.77 mm was obtained that was a composite of the polyurethane, and the non-woven fabric that was an entangle body of fiber bundles of ultrafine fibers of the PET filaments. Since the non-woven fabric of the ultrafine fibers was formed by removing the sea component after impregnating the polyurethane into the non-woven fabric, the ultrafine fibers in the fiber bundles are not fixed to each other by the polyurethane, and the ultrafine fibers are not constrained.

Then, after slicing the artificial leather substrate in half, a solvent mixture of DMF/cyclohexanone=30/70 (weight ratio) was applied to a main surface that was to form a napped surface, and dried, to fix the polyurethane to the ultrafine fibers in the surface layer portion of artificial leather substrate. Thereafter, both surfaces of the half-slice artificial leather substrate were buffed, using a paper with a grit number of 120 for the back surface and papers with grit numbers of 240, 320, and 600 for the main surface, whereby the artificial leather substrate was finished into an artificial leather substrate with a napped surface formed thereon. Then, the artificial leather substrate with a napped surface formed thereon was subjected to high-pressure dyeing at 120° C. using a disperse dye, thereby obtaining a napped artificial leather having a suede-like napped surface. Then the napped artificial leather was evaluated according to the above-described evaluation methods. The results are shown in Table 2.

TABLE 2

| Example No. | Ex. 7 | Ex. 8 | Ex. 9 | Ex. 10 | Ex. 11 | Ex. 12 | Ex. 13 | Ex. 14 |
|---|---|---|---|---|---|---|---|---|
| Fiber length | Filament | Filament | Filament | Filament | Filament | Filament | Filament | Filament |
| Fineness (dtex) | 0.22 | 0.20 | 0.20 | 0.41 | 0.21 | 0.23 | 0.22 | 0.22 |
| Tensile strength (A), (mN) | 7.8 | 6.6 | 6.6 | 7.7 | 7 | 7.5 | 7.8 | 7.7 |
| Elastic polymer ratio (B), (%) | 32 | 29 | 30 | 30 | 22 | 37 | 32 | 31 |
| 3.125 × (A) | 24.4 | 20.6 | 20.6 | 24.1 | 21.9 | 23.4 | 24.4 | 24.1 |
| Apparent density (g/cm$^3$) | 0.405 | 0.427 | 0.419 | 0.420 | 0.456 | 0.460 | 0.415 | 0.410 |
| Thickness (mm) | 0.82 | 0.80 | 0.80 | 0.80 | 0.80 | 0.82 | 0.81 | 0.82 |
| Basis weight (g/m$^2$) | 332 | 342 | 335 | 336 | 365 | 377 | 336 | 336 |
| Island component resin | PET | PET | PET | PET | PET | PET | PET | PET |
| Intrinsic viscosity (dl/g) | 0.67 | 0.62 | 0.62 | 0.59 | 0.67 | 0.67 | 0.67 | 0.67 |
| Melting point (° C.) | 251 | 250 | 250 | 249 | 251 | 251 | 251 | 251 |
| CB content ratio (%) | 1.0 | 1.0 | 1.0 | 1.0 | 0 | 1.0 | 1.0 | 1.0 |
| Sea component resin | PE | PE | PE | PE | PE | PE | PE | PE |
| Melting point (° C.) | 109 | 109 | 109 | 109 | 109 | 109 | 109 | 109 |
| MFR (g/10 min, PE 190° C., PVA 230° C.) | 25 | 25 | 25 | 25 | 25 | 25 | 25 | 25 |

TABLE 2-continued

| | | | | | | | | |
|---|---|---|---|---|---|---|---|---|
| Sea/Island melting point difference (° C.) | 142 | 141 | 141 | 140 | 142 | 142 | 142 | 142 |
| Number of islands (islands) | 12 | 12 | 12 | 6 | 12 | 12 | 12 | 12 |
| Sea/Island ratio (%) | 35/65 | 35/65 | 35/65 | 35/65 | 35/65 | 35/65 | 35/65 | 35/65 |
| Nozzle diameter (mm) | 0.4 | 0.4 | 0.4 | 0.4 | 0.4 | 0.4 | 0.4 | 0.4 |
| Throughput per hole (g/min) | 1.5 | 1.5 | 1.5 | 1.5 | 1.2 | 1.5 | 1.5 | 1.5 |
| Spinning rate (m/min) | 3450 | 3200 | 3200 | 3570 | 3100 | 3450 | 3450 | 3450 |
| Spinning draft | 279 | 259 | 259 | 289 | 337 | 279 | 279 | 279 |
| Application of solvent or polyurethane solution onto surface after half slicing | Done | Done | Not done | Done | Not done | Done | Not done | Not done |
| PU expansion ratio (%) | 1.3 | 1.8 | 2.5 | 1.3 | 1.4 | 28.0 | 3.2 | 0.900 |
| Apparent density of web entangled sheet after pressing (g/cm$^3$) | 0.400 | 0.4 | 0.380 | 0.400 | 0.480 | 0.405 | 0.380 | 0.402 |
| Concentration of polyurethane DMF solution (%) | 18.5 | 18.5 | 18.5 | 18.5 | 16.0 | 25 | 21.0 | 18.5 |
| Coagulation regulator | Not used | Not used | Not used | Not used | Not used | Not used | Not used | Not used |
| Crocking (Dry, grade) | 4-5 | 4-5 | 4-5 | 4 | 4-5 | 4 | 4-5 | 4 |
| (Wet, grade) | 4 | 4-5 | 4 | 4 | 4 | 4 | 4 | 4 |
| Colour fastness to rubbing (Dry, grade) | 4-5 | 4-5 | 4-5 | 4-5 | 4-5 | 4-5 | 4-5 | 4-5 |
| (Wet, grade) | 3-4 | 3-4 | 3-4 | 3-4 | 3-4 | 3-4 | 3-4 | 3-4 |
| Abrasion loss (mg) | 27.5 | 37.8 | 37.8 | 32.0 | 35.6 | 23.2 | 32.0 | 35.4 |
| Softness (mm) | 4.4 | 4.1 | 4.4 | 4.1 | 4.1 | 4.2 | 3.7 | 4.1 |
| Texture | A | A | A | A | A | A | A | A |
| Appearance | A | A | A | A | A | A | A | A |
| Pilling resistance (5000 cycles, grade) | 5 | 5 | 5 | 5 | 4 | 5 | 5 | 5 |

| Example No. | Ex. 15 | Ex. 16 | Ex. 17 | Ex. 18 | Ex. 19 | Ex. 20 |
|---|---|---|---|---|---|---|
| Fiber length | Filament | Filament | Filament | Filament | Filament | Staple |
| Fineness (dtex) | 0.22 | 0.22 | 0.20 | 0.28 | 0.20 | 0.20 |
| Tensile strength (A), (mN) | 7.8 | 7.8 | 6.6 | 7.9 | 7 | 6.5 |
| Elastic polymer ratio (B), (%) | 28 | 25 | 23 | 29 | 22 | 29 |
| 3.125 × (A) | 24.4 | 24.4 | 20.6 | 24.7 | 21.9 | 20.3 |
| Apparent density (g/cm$^3$) | 0.475 | 0.402 | 0.402 | 0.394 | 0.409 | 0.474 |
| Thickness (mm) | 0.80 | 0.84 | 0.84 | 0.82 | 0.81 | 0.80 |
| Basis weight (g/m$^2$) | 380 | 338 | 338 | 323 | 331 | 379 |
| Island component resin | PET | PET | PET | PET | PET | PET |
| Intrinsic viscosity (dl/g) | 0.67 | 0.67 | 0.62 | 0.62 | 0.62 | 0.62 |
| Melting point (° C.) | 251 | 251 | 250 | 250 | 250 | 250 |
| CB content ratio (%) | 1.0 | 1.0 | 1.0 | 1.0 | 1.0 | 1.0 |
| Sea component resin | FE | PE | PE | PE | PE | PE |
| Melting point (° C.) | 109 | 109 | 109 | 109 | 109 | 109 |
| MFR (g/10 min, PE 190° C., PVA 230° C.) | 25 | 25 | 25 | 25 | 25 | 25 |
| Sea/Island melting point difference (° C.) | 142 | 142 | 141 | 141 | 141 | 141 |
| Number of islands (islands) | 12 | 12 | 12 | 12 | 12 | 12 |
| Sea/Island ratio (%) | 35/65 | 35/65 | 35/65 | 25/75 | 35/65 | 35/65 |
| Nozzle diameter (mm) | 0.4 | 0.4 | 0.4 | 0.4 | 0.4 | 0.4 |
| Throughput per hole (g/min) | 1.5 | 1.5 | 1.5 | 1.6 | 1.6 | 1.5 |
| Spinning rate (m/min) | 3450 | 3450 | 3200 | 3000 | 3400 | 3500 |
| Spinning draft | 279 | 279 | 259 | 240 | 275 | 299 |
| Application of solvent or polyurethane solution onto surface after half slicing | Not done | Not done | Not done | Not done | Not done | Not done |

TABLE 2-continued

| | | | | | | |
|---|---|---|---|---|---|---|
| PU expansion ratio (%) | 4.5 | 0.9 | 1.6 | 1.5 | 1.5 | 1.2 |
| Apparent density of web entangled sheet after pressing (g/cm$^3$) | 0.480 | 0.400 | 0.410 | 0.400 | 0.400 | 0.480 |
| Concentration of polyurethane DMF solution (%) | 25.0 | 14.0 | 14.0 | 18.5 | 18.5 | 25.0 |
| Coagulation regulator | Not used | Not used | Not used | Not used | Not used | Not used |
| Crocking (Dry, grade) | 4-5 | 4-5 | 4-5 | 4-5 | 4-5 | 4-5 |
| (Wet, grade) | 4 | 4 | 4 | 4 | 4 | 4 |
| Colour fastness to rubbing (Dry, grade) | 4-5 | 4-5 | 4-5 | 4-5 | 4-5 | 4-5 |
| (Wet, grade) | 3-4 | 3-4 | 3-4 | 3-4 | 3-4 | 3-4 |
| Abrasion loss (mg) | 32.0 | 27.5 | 37.8 | 29.8 | 31.1 | 31.0 |
| Softness (mm) | 3.7 | 4.3 | 4.2 | 4 | 4.4 | 4.4 |
| Texture | A | A | A | A | A | A |
| Appearance | A | A | A | A | A | A |
| Pilling resistance (5000 cycles, grade) | 5 | 4 | 4 | 4 | 4 | 5 |

Examples 8 to 22, 24 to 33, Comparative Examples 8 to 10

In Examples 8 to 19, 21 to 22, and 24 to 33, and Comparative Examples 8 to 10, napped artificial leathers were obtained and evaluated in the same manner as in Example 7 except that the intrinsic viscosity, the melting point, or the CB content ratio of the PET, or the spinning conditions of the island-in-the-sea composite fibers, the content ratio of the elastic polymer, whether or not to perform application and drying of the solvent mixture of DMF/cyclohexanone, or the like was set as shown in Table 2, or Table 3 below. In Example 20, a napped artificial leather was obtained and evaluated in the same manner as in Example 7 except that a staple web was formed by carding a raw stock of staples of the island-in-the-sea composite fiber obtained by crimping and cutting the melt-spun island-in-the-sea composite fibers. The results of the evaluation are shown in Table 2, or Table 3 below.

TABLE 3

| Example No. | Ex. 21 | Ex. 22 | Ex. 23 | Com. Ex. 8 | Com. Ex. 9 | Ex. 24 | Ex. 25 | Ex. 26 | Ex. 27 |
|---|---|---|---|---|---|---|---|---|---|
| Fineness (dtex) | 0.22 | 0.20 | 0.11 | 0.22 | 0.21 | 0.38 | 0.24 | 0.24 | 0.24 |
| Tensile strength (A), (mN) | 7.8 | 6.6 | 6.7 | 7.8 | 5.2 | 8.2 | 8.2 | 8.2 | 8.2 |
| Elastic polymer ratio (B), (%) | 21 | 19 | 21 | 30 | 28 | 29 | 34 | 26 | 23 |
| 3.125 × (A) | 24.4 | 20.6 | 20.9 | 24.4 | 16.3 | 25.6 | 25.6 | 25.6 | 25.6 |
| Apparent density (g/m$^3$) | 0.430 | 0.450 | 0.550 | 0.350 | 0.400 | 0.400 | 0.440 | 0.430 | 0.440 |
| Thickness (mm) | 0.8 | 0.83 | 0.8 | 0.81 | 0.82 | 0.79 | 0.79 | 0.77 | 0.80 |
| Basis weight (g/m$^2$) | 344 | 374 | 440 | 284 | 328 | 316 | 348 | 331 | 352 |
| Island component resin | PET | PET | PET | PET | PET | PET | PET | PET | PET |
| Intrinsic viscosity (dl/g) | 0.67 | 0.62 | 0.62 | 0.67 | 0.59 | 0.67 | 0.67 | 0.67 | 0.67 |
| Melting point (° C.) | 251 | 250 | 240 | 251 | 240 | 249 | 249 | 249 | 249 |
| CB content ratio (%) | 1.0 | 1.0 | 0 | 1.0 | 1.0 | 1.0 | 1.0 | 1.0 | 1.0 |
| Sea component resin | PE | PE | PVA | PE | PE | PE | PE | PE | PE |
| Melting point (° C.) | 109 | 109 | 206 | 109 | 109 | 109 | 109 | 109 | 109 |
| MFR (g/10 min, PE 190° C., PVA 230° C.) | 25 | 25 | 83 | 25 | 25 | 25 | 25 | 25 | 25 |
| Sea/Island melting point difference (° C.) | 142 | 142 | 142 | 142 | 131 | 140 | 140 | 140 | 140 |
| Number of islands (islands) | 12 | 12 | 25 | 12 | 12 | 6 | 12 | 12 | 12 |
| Sea/Island ratio (%) | 35/65 | 35/65 | 25/75 | 35/65 | 35/65 | 35/65 | 35/65 | 35/65 | 35/65 |
| Nozzle diameter (mm) | 0.4 | 0.4 | 0.4 | 0.4 | 0.4 | 0.4 | 0.4 | 0.4 | 0.4 |
| Throughput per hole (g/min) | 1.5 | 1.5 | 1.0 | 1.5 | 1.5 | 1.5 | 1.5 | 1.5 | 1.5 |
| Spinning rate (m/min) | 3450 | 3200 | 3300 | 3450 | 3900 | 3500 | 3200 | 3200 | 3200 |
| Spinning draft | 279 | 259 | 493 | 279 | 315 | 288 | 263 | 263 | 263 |
| Application of solvent or polyurethane solution onto surface after half slicing | Not done | Not done | Not done | Not done | Not done | Not done | Not done | Not done | Not done |

TABLE 3-continued

| | | | | | | | | | |
|---|---|---|---|---|---|---|---|---|---|
| PU expansion ratio (%) | 1.2 | 1.6 | 1.0 | 3.3 | 1.2 | 1.2 | 1.2 | 3.3 | 4.5 |
| Apparent density of web entangled sheet after pressing ($g/cm^3$) | 0.423 | 0.454 | 0.491 | 0.370 | 0.424 | 0.415 | 0.428 | 0.434 | 0.430 |
| Concentration of polyurethane DMF solution (%) | 14.0 | 14.0 | 25.0 | 16.0 | 18.5 | 18.5 | 25.0 | 18.5 | 16.0 |
| Coagulation regulator | Not used | Not used | Not used | Not used | Not used | Not used | Not used | Not used | Not used |
| Crocking (Dry, grade) | 4-5 | 4-5 | 4-5 | 4-5 | 3 | 4-5 | 4-5 | 4-5 | 4-5 |
| (Wet, grade) | 4 | 3-4 | 3-4 | 3-4 | 1-2 | 4-5 | 4-5 | 4 | 4 |
| Colour fastness to rubbing (Dry, grade) | 4-5 | 4 | 4 | 4 | 3 | 4-5 | 4-5 | 4-5 | 4-5 |
| (Wet, grade) | 3-4 | 3-4 | 3-4 | 3-4 | 1-2 | 3-4 | 3-4 | 3-4 | 3-4 |
| Abrasion loss (mg) | 29.3 | 48.3 | 41.1 | 31.5 | 65.2 | 22.2 | 27.3 | 25.3 | 22.1 |
| Softness (mm) | 4.3 | 4.2 | 3.3 | 4.2 | 4.3 | 4 | 3.9 | 4 | 4.1 |
| Texture | A | A | B | A | A | A | A | A | A |
| Appearance | A | A | A | B | A | A | A | A | A |
| Pilling resistance (5000 cycles, grade) | 2 | 2 | 5 | 5 | 4 | 2 | 3 | 2 | 2 |

| Example No. | Com. Ex. 10 | Ex. 28 | Ex. 29 | Ex. 30 | Ex. 31 | Ex. 32 | Com. Ex. 11 | Ex. 33 |
|---|---|---|---|---|---|---|---|---|
| Fineness (dtex) | 0.22 | 0.19 | 0.19 | 0.19 | 0.19 | 0.22 | 0.03 | 0.21 |
| Tensile strength (A), (mN) | 7.8 | 6.4 | 6.4 | 6.4 | 6.4 | 7.8 | 0.8 | 7.7 |
| Elastic polymer ratio (B), (%) | 41 | 36 | 28 | 20 | 18 | 20 | 12 | 18 |
| 3.125 × (A) | 24.4 | 20.0 | 20.0 | 20.0 | 20.0 | 24.4 | 2.5 | 24.1 |
| Apparent density ($g/m^3$) | 0.480 | 0.400 | 0.400 | 0.440 | 0.470 | 0.450 | 0.430 | 0.438 |
| Thickness (mm) | 0.81 | 0.8 | 0.81 | 0.8 | 0.79 | 0.82 | 0.8 | 0.80 |
| Basis weight ($g/m^2$) | 389 | 320 | 324 | 352 | 371 | 369 | 344 | 349 |
| Island component resin | PET | PET | PET | PET | PET | PET | PET | PET |
| Intrinsic viscosity (dl/g) | 0.67 | 0.62 | 0.62 | 0.62 | 0.62 | 0.67 | 0.62 | 0.67 |
| Melting point (° C.) | 251 | 250 | 250 | 250 | 250 | 251 | 240 | 251 |
| CB content ratio (%) | 1.0 | 1.0 | 1.0 | 1.0 | 1.0 | 1.0 | 0 | 0 |
| Sea component resin | PE | PE | PE | PE | PE | PE | PVA | PE |
| Melting point (° C.) | 109 | 109 | 109 | 109 | 109 | 109 | 206 | 109 |
| MFR (g/10 min, PE 190° C., PVA 230° C.) | 25 | 25 | 25 | 25 | 25 | 25 | 83 | 25 |
| Sea/Island melting point difference (° C.) | 142 | 141 | 141 | 141 | 141 | 142 | 142 | 142 |
| Number of islands (islands) | 12 | 12 | 12 | 12 | 12 | 12 | 120 | 12 |
| Sea/Island ratio (%) | 35/65 | 35/65 | 35/65 | 35/65 | 35/65 | 35/65 | 35/65 | 35/65 |
| Nozzle diameter (mm) | 0.4 | 0.4 | 0.4 | 0.4 | 0.4 | 0.4 | 0.4 | 0.4 |
| Throughput per hole (g/min) | 1.5 | 1.5 | 1.5 | 1.5 | 1.5 | 1.5 | 1.0 | 1.2 |
| Spinning rate (m/min) | 3450 | 3300 | 3300 | 3300 | 3300 | 3450 | 3200 | 3100 |
| Spinning draft | 279 | 265 | 265 | 265 | 265 | 279 | 487 | 337 |
| Application of solvent or polyurethane solution onto surface after half slicing | Not done | Not done | Not done | Not done | Not done | Not done | Not done | Done |
| PU expansion ratio (%) | 4.4 | 1.0 | 3.3 | 1.2 | 1.2 | 32.0 | 1.2 | 1.9 |
| Apparent density of web entangled sheet after pressing ($g/cm^3$) | 0.411 | 0.413 | 0.395 | 0.430 | 0.465 | 0.434 | 0.403 | 0.450 |
| Concentration of polyurethane DMF solution (%) | 25.0 | 20.0 | 18.5 | 14.0 | 14.0 | 14.0 | 9.0 | 14 |
| Coagulation regulator | Not used | Not used | Not used | Not used | Not used | Used | Not used | Not used |
| Crocking (Dry, grade) | 4-5 | 4-5 | 4-5 | 4-5 | 4-5 | 4-5 | 2-3 | 4-5 |
| (Wet, grade) | 4-5 | 4 | 4 | 4 | 4 | 4 | 1 | 3-4 |
| Colour fastness to rubbing (Dry, grade) | 4-5 | 4-5 | 4-5 | 4-5 | 4-5 | 4-5 | 2-3 | 4-5 |
| (Wet, grade) | 3-4 | 3-4 | 3-4 | 3 | 3 | 3-4 | 1 | 4 |
| Abrasion loss (mg) | 19.8 | 40.3 | 46.7 | 49.7 | 50.4 | 32.2 | 109 | 31.5 |
| Softness (mm) | 4 | 4 | 4.0 | 4.2 | 3.9 | 4.0 | 4.8 | 4.7 |
| Texture | A | A | A | A | A | A | A | A |

TABLE 3-continued

| | | | | | | | | |
|---|---|---|---|---|---|---|---|---|
| Appearance | B | A | A | A | A | A | A | A |
| Pilling resistance (5000 cycles, grade) | 5 | 5 | 5 | 4 | 2 | 5 | 5 | 2 |

Example 23, Comparative Example 11

In Example 23 and Comparative Example 11, napped artificial leathers were obtained and evaluated in the same manner as in Comparative Example 6 except that the intrinsic viscosity of PET, the spinning conditions of the island-in-the-sea composite fibers, the content ratio of the elastic polymer, whether or not to perform application and drying of the solvent mixture of DMF/cyclohexanone, or the like was set as shown in Table 3 The results of the evaluation are shown in Table 3.

Figure 2:
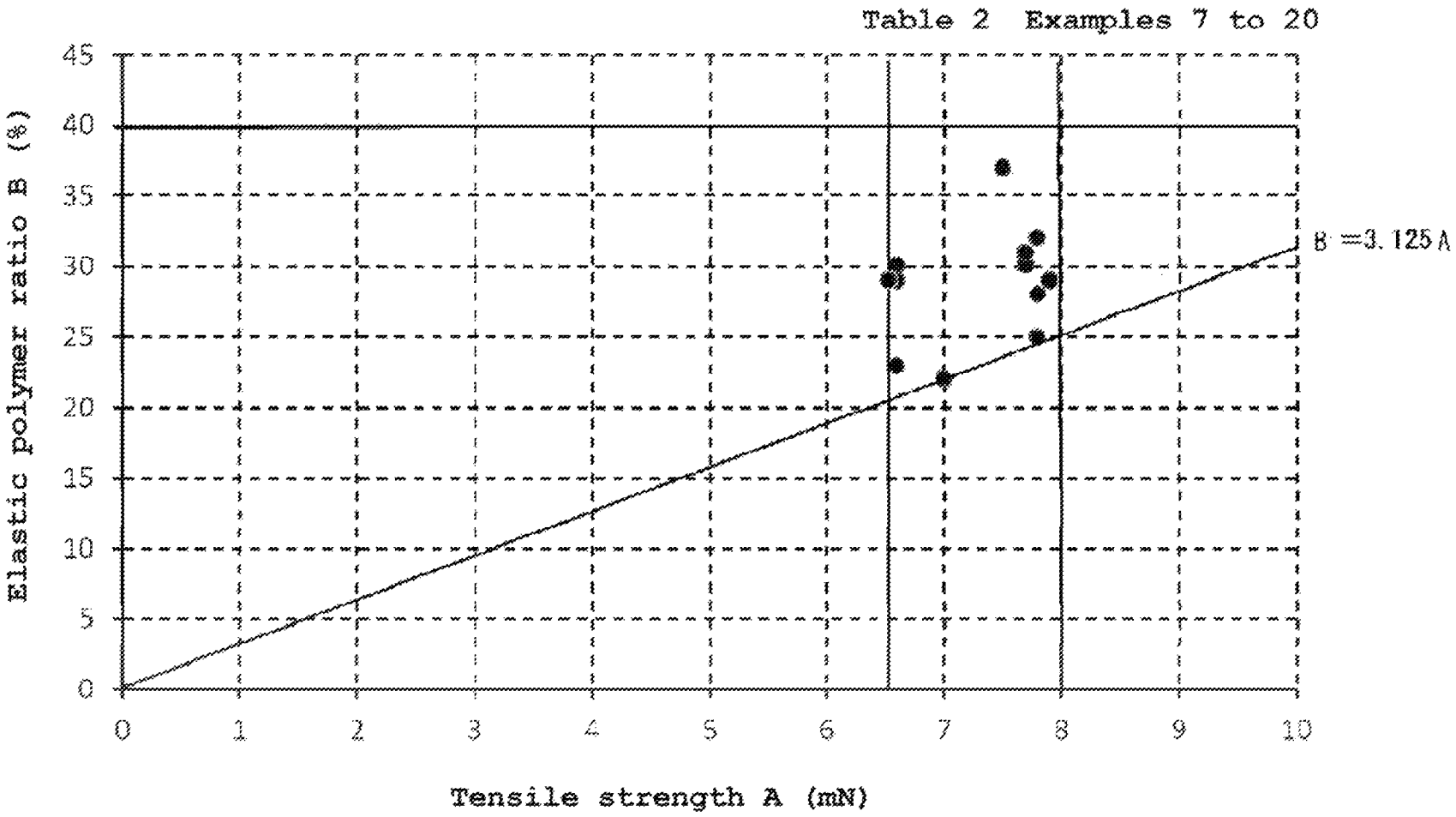
FIG. 2 is a graph plotting a content ratio (B) of an elastic polymer included in each of the napped artificial leathers obtained in Examples 7 to 20, relative to a tensile strength (A) of ultrafine fibers.
Figure 3:
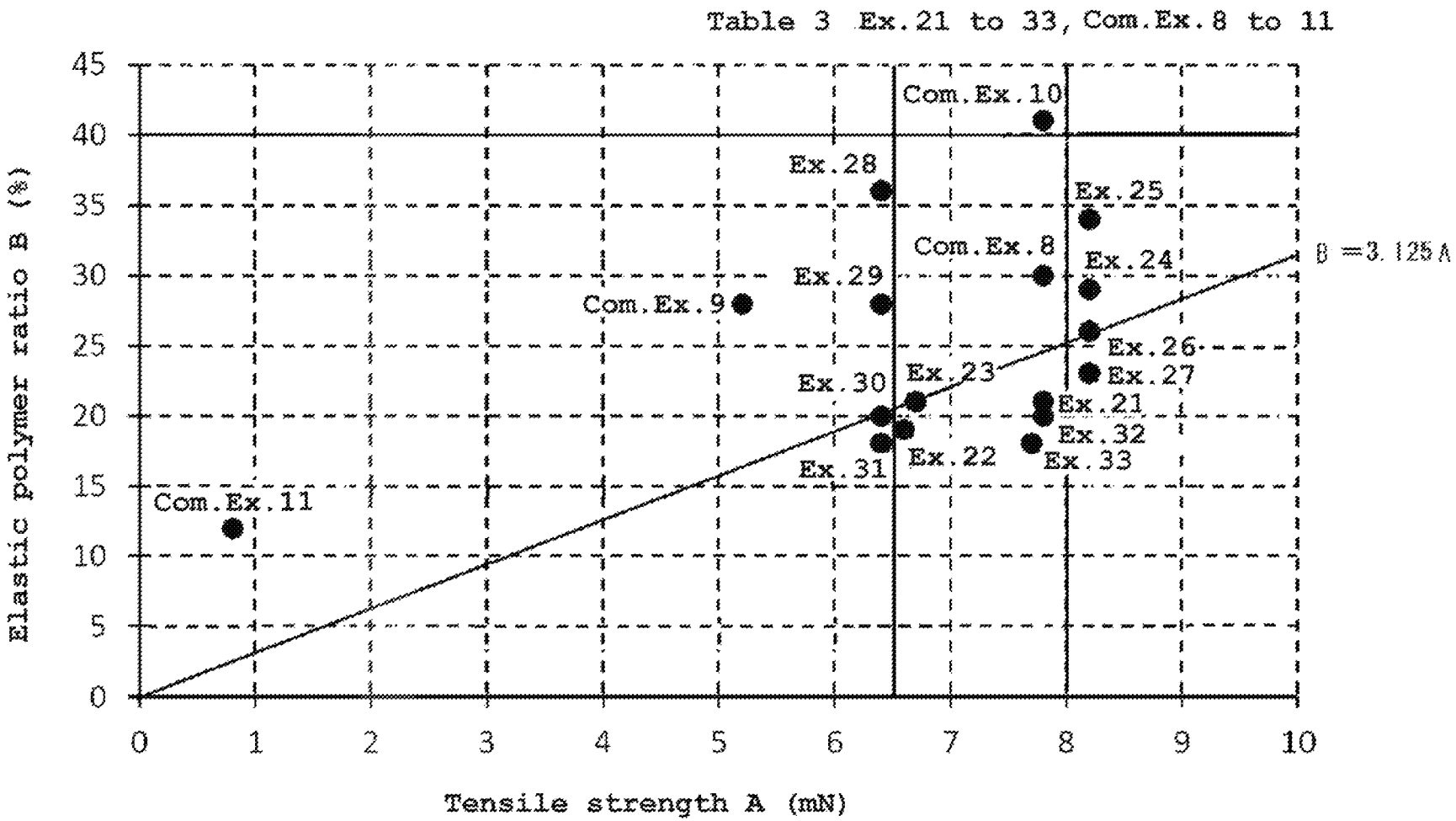
FIG. 3 is a graph plotting a content ratio (B) of an elastic polymer contained in each of the napped artificial leathers obtained in Examples 21 to 33 and Comparative Examples 8 to 11, relative to a tensile strength (A) of ultrafine fibers.

FIG. 2 shows a graph plotting the content ratio (B) of the elastic polymer included in each of the napped artificial leathers listed in Table 2, relative to the tensile strength (A) of the ultrafine fibers. FIG. 3 shows a graph plotting the content ratio (B) of the elastic polymer included in each of the napped artificial leathers listed in Table 3, relative to the tensile strength (A) of the ultrafine fibers.

Referring to Table 2, as shown in FIG. 2, the napped artificial leathers obtained in Examples 7 to 20 had a tensile strength (A) in the range of 6.5 to 8 mN, and the content ratio (B) % of the elastic polymer satisfied $3.125\times(A)\leq(B)$. Referring to Table 2, these napped artificial leathers had a combination of high pilling resistance of grade 4 or higher, high abrasion resistance of an abrasion loss of 40 mg or less, a soft texture exhibiting a softness of 3.7 mm or more, and an elegant napped appearance with a napped surface having a soft smooth touch, with finely loosened fibers with a uniform length.

Referring to Table 3, as shown in FIG. 3, Examples 21, 22, 24 to 27, and 28 to 33 had a tensile strength (A) in the range of 6.5 to 8 mN, and the content ratio (B) % of the elastic polymer did not satisfy $3.125\times(A)\leq(B)$. Referring to Table 3, these napped artificial leathers had rather low pilling resistance or abrasion resistance. Example 23, which had a high apparent density, had a hard texture.

The invention claimed is:

1. A napped artificial leather, comprising:

a non-woven fabric that is an entangle body of ultrafine fibers; and an elastic polymer applied into the non-woven fabric, the napped artificial leather having, on at least one side thereof, a napped surface formed by napping the ultrafine fibers, wherein each of the ultrafine fibers is an ultrafine fiber of a polyethylene terephthalate having a fineness of 0.15 to 0.5 dtex and a tensile strength of 6 to 9 mN, and a plurality of the ultrafine fibers form a fiber bundle, the ultrafine fibers that form the fiber bundle are not constrained by the elastic polymer in a region of the napped artificial leather other than a surface layer portion, the elastic polymer having an expansion ratio of 0.9 to 5%, a content ratio of the elastic polymer is 16 to 40 mass %, and the napped artificial leather has an apparent density of 0.38 or more.

2. The napped artificial leather according to claim 1, wherein the tensile strength is a tensile strength A (mN) in the range of 6.5 to 8 mN, the apparent density is 0.38 to 0.48 g/cm$^3$ and a content ratio B (%) of the elastic polymer satisfies $3.125\times A\leq B$.

3. The napped artificial leather according to claim 1, wherein the elastic polymer is a nonaqueous solvent-based polyurethane.

4. The napped artificial leather according to claim 1, wherein a portion of the elastic polymer that is present in the surface layer portion is fixed to the vicinity of a base of the napped ultrafine fibers.

5. The napped artificial leather according to claim 1, wherein each of the ultrafine fibers is an ultrafine fiber formed by removing by dissolution a sea component from an island-in-the-sea composite fiber, using an organic solvent.

6. The napped artificial leather according to claim 1, wherein the non-woven fabric is a spunbonded non-woven fabric including the ultrafine filaments.

7. The napped artificial leather according to claim 3, wherein the nonaqueous solvent-based polyurethane is a polyurethane that solidified from a polyurethane-solution including N,N-dimethylformamide, by wet coagulation.

* * * * *